US010933555B2

(12) United States Patent
Rompré

(10) Patent No.: US 10,933,555 B2
(45) Date of Patent: Mar. 2, 2021

(54) PROCESS AND APPARATUS FOR TREATING LIGNOCELLULOSIC MATERIAL

(71) Applicant: 9274-0273 Quebec, Inc., Quebec (CA)

(72) Inventor: Stéphane Rompré, Quebec (CA)

(73) Assignee: Technologies Boralife Inc., Quebec (CA)

( * ) Notice: Subject to any disclaimer, the term of this patent is extended or adjusted under 35 U.S.C. 154(b) by 0 days.

(21) Appl. No.: 15/319,456

(22) PCT Filed: Jun. 23, 2015

(86) PCT No.: PCT/CA2015/050583
§ 371 (c)(1),
(2) Date: Dec. 16, 2016

(87) PCT Pub. No.: WO2015/196285
PCT Pub. Date: Dec. 30, 2015

(65) Prior Publication Data

US 2017/0120472 A1 May 4, 2017

Related U.S. Application Data

(60) Provisional application No. 62/016,893, filed on Jun. 25, 2014.

(51) Int. Cl.
*B27K 3/02* (2006.01)
*B27K 3/20* (2006.01)
(Continued)

(52) U.S. Cl.
CPC ..... *B27K 3/0207* (2013.01); *B27K 3/0278* (2013.01); *B27K 3/0285* (2013.01);
(Continued)

(58) Field of Classification Search
CPC ..... B27K 3/0207
See application file for complete search history.

(56) References Cited

U.S. PATENT DOCUMENTS 1,613,459 A 1/1927 Himmelsbach
2,351,210 A 6/1944 Hobbs
(Continued)

FOREIGN PATENT DOCUMENTS

CA 1216709 A 1/1987
CA 2591760 A1 12/2008
(Continued)

OTHER PUBLICATIONS

Canadian Intellectual Property Office; International Search Report; dated Sep. 3, 2015; 3 pages.
(Continued)

*Primary Examiner* — Nathan H Empie
(74) *Attorney, Agent, or Firm* — Price Heneveld LLP

(57) ABSTRACT

A process for treating lignocellulosic pieces with a water-soluble lignocellulosic material preservative. The process comprises the step of contacting the lignocellulosic pieces with a water-based preservative solution having a contact temperature between about 70° C. and about 95° C., the water-based preservative solution containing the water-soluble lignocellulosic material preservative in a concentration above about 25% wt. A lignocellulosic treatment apparatus for treating lignocellulosic pieces is also provided.

16 Claims, 19 Drawing Sheets

(51) Int. Cl.

| | |
|---|---|
| ***B27K 5/00*** | (2006.01) |
| ***B27K 3/04*** | (2006.01) |
| ***B27K 3/12*** | (2006.01) |
| ***B27K 3/16*** | (2006.01) |

(52) U.S. Cl.
CPC ..... *B27K 3/04* (2013.01); *B27K 3/12* (2013.01); *B27K 3/163* (2013.01); *B27K 3/20* (2013.01); *B27K 5/001* (2013.01)

(56) References Cited

U.S. PATENT DOCUMENTS

| | | | | |
|---|---|---|---|---|
| 3,571,943 | A | 3/1971 | Sipple | |
| 4,413,023 | A | 11/1983 | Chow | |
| 4,532,161 | A | 7/1985 | Collins et al. | |
| 4,657,789 | A | 4/1987 | Lars | |
| 4,719,110 | A * | 1/1988 | Patel | A01N 3/00 424/660 |
| 4,731,267 | A | 3/1988 | Makus et al. | |
| 5,024,861 | A | 6/1991 | Vinden et al. | |
| 5,030,483 | A * | 7/1991 | Drinkard, Jr. | B27K 3/0292 427/336 |
| 5,582,871 | A * | 12/1996 | Silenius | B27K 3/346 252/380 |
| 6,217,939 | B1 | 4/2001 | Sailer et al. | |
| 6,753,016 | B2 * | 6/2004 | Ghosh | B27K 3/16 424/604 |
| 2002/0025385 | A1 | 2/2002 | Bergervoet | |
| 2003/0224123 | A1 * | 12/2003 | Lopez | B27K 3/025 427/440 |
| 2005/0038182 | A1 | 2/2005 | Hermescec et al. | |
| 2006/0013957 | A1 | 1/2006 | Roy | |
| 2006/0127432 | A1 | 6/2006 | Romero Amaya | |
| 2007/0122644 | A1 | 5/2007 | Jarck | |
| 2008/0063884 | A1 | 3/2008 | Robinson et al. | |
| 2009/0280345 | A1 | 11/2009 | Maynard et al. | |
| 2009/0304939 | A1 | 12/2009 | Korpela | |
| 2012/0258248 | A1 | 10/2012 | Ross et al. | |

FOREIGN PATENT DOCUMENTS

| | | | |
|---|---|---|---|
| CN | 101195228 | A | 6/2008 |
| CN | 101780683 | A | 7/2010 |
| CN | 102431067 | A | 5/2012 |
| DE | 3630743 | A1 | 3/1988 |
| DK | 29777 | A | 7/1977 |
| ES | 1065471 | U | 8/2007 |
| FR | 592932 | A | 8/1925 |
| FR | 606215 | A | 6/1926 |
| FR | 2293292 | A1 | 7/1976 |
| FR | 2620644 | A1 | 3/1989 |
| FR | 2934258 | A1 | 1/2010 |
| GB | 190414183 | A | 2/1905 |
| GB | 190424451 | A | 7/1905 |
| GB | 241155 | A | 2/1926 |
| GB | 286892 | A | 3/1928 |
| GB | 295126 | A | 8/1928 |
| GB | 700047 | A | 11/1953 |
| GB | 865108 | A | 4/1961 |
| GB | 950938 | A | 2/1964 |
| GB | 1473660 | A | 5/1977 |
| JP | H107502 | A | 1/1998 |
| JP | H1148213 | A | 2/1999 |
| JP | 2003136511 | A | 5/2003 |
| JP | 2006029726 | A | 2/2006 |
| JP | 2012091384 | A | 5/2012 |
| KR | 920001479 | B1 | 2/1992 |
| SU | 1276493 | A1 | 12/1986 |
| WO | 9000959 | A1 | 2/1990 |
| WO | 0043177 | A1 | 7/2000 |
| WO | 02102560 | A1 | 12/2002 |
| WO | 2006026854 | A1 | 3/2006 |
| WO | 2006039526 | A2 | 4/2006 |
| WO | 2006051155 | A1 | 5/2006 |
| WO | 2007046716 | A1 | 4/2007 |
| WO | 2009013361 | A1 | 1/2009 |
| WO | 2010078413 | A1 | 7/2010 |

OTHER PUBLICATIONS

J D Lloyd & M J Manning; Developments in Borate Preservation Technology; B.W.P.D.A. Annual Convention 1995; 1995.

* cited by examiner

PROCESS AND APPARATUS FOR TREATING LIGNOCELLULOSIC MATERIAL

CROSS REFERENCE TO RELATED APPLICATION

This application claims the benefit under 35 U.S.C. § 119(e) of U.S. provisional patent application No. 62/016,893 which was filed on Jun. 25, 2014. The entirety of the aforementioned application is herein incorporated by reference. This application is a national phase entry of PCT patent application serial number PCT/CA2015/050583, filed on Jun. 23, 2015, designating the United States of America.

TECHNICAL FIELD OF THE INVENTION

The present invention relates to the field of lignocellulosic material treatment. More particularly, it relates to an apparatus and a process for the treatment of lignocellulosic material using a water-soluble preservative.

BACKGROUND

It is known in the art that untreated (or unprotected) lignocellulosic material, such as wood pieces, engineered wood pieces, or the like, are commonly subjected to premature attack by fungi and/or insects, thereby negatively impacting on the structural properties thereof.

Therefore, various methods and processes have been developed throughout the years in order to mitigate the effect of such fungi and/or insects on the durability and resistance of lignocellulosic material. For example, a pressure treatment process using chromated copper arsenate (CCA) wood preservative has been widely used for timber treatment for many decades. Such CCA treatment however now raises health concerns, therefore limiting its use. For example, some studies have shown that, over time, chemical can leach from the pieces of CCA treated wood and into surrounding soil, or can be dislodged from the wood surface upon contact with skin, thereby leading to exposure to inorganic arsenic which can present certain hazards. Moreover, toxic chemicals may be produced as part of the smoke and ashes of CAA treated wood, when burnt in open fires, stoves, fireplaces, residential boilers, or the like. Consequently, many countries now restrict the use of CAA treated wood, especially in residential constructions. For example, since Jan. 1, 2004, the United-States Environmental Protection Agency (EPA) has banned the use of CCA in treated timber for residential timber.

Alternative chemical preservatives used for treatment of timbers include water soluble preservatives, such as borate, which offer marginal environment impacts and are recognized for their non-hazardous effect on mammalians. However, wood species harvested in northern United States and Canada for lumber and construction purposes, such as, for example and without being limitative, Balsam Fir and Spruce, are seldom treated with a water-soluble preservative, such as borate, since the treatment process for these wood species is more intricate and more expensive than for southern wood species.

In order to alleviate such drawbacks, various methods, such as batch pressure treatment or the like, have been developed in connection with impregnating or diffusing the water-soluble preservative into the wood structure. However, known treatment methods tend to suffer from several drawbacks. For example, there is still a need to increase the water-soluble preservative retention yield and/or to decrease the treatment process time in order to increase the production efficiency for treating lignocellulosic material using water soluble preservatives.

In view of the above, there is a need for an improved apparatus and/or process for the treatment of lignocellulosic material, which would be able to overcome or at least minimize some of the above-discussed prior art concerns.

BRIEF SUMMARY OF THE INVENTION

According to a first general aspect, there is provided a process for treating lignocellulosic pieces with a water-soluble lignocellulosic material preservative. The process comprises the step of contacting the lignocellulosic pieces with a water-based preservative solution having a contact temperature between about 70° C. and about 95° C., the water-based preservative solution containing the water-soluble lignocellulosic material preservative in a concentration above about 25% wt.

In an embodiment, the preservative solution has a temperature between about 85° C. and about 95° C.

In an embodiment, the preservative solution contains the water-soluble lignocellulosic material preservative in a concentration between about 40% wt and about 50% wt.

In an embodiment, the preservative solution contains the water-soluble lignocellulosic material preservative in a concentration between about 45% wt and about 47% wt.

In an embodiment, the step of contacting the lignocellulosic pieces with the water-based preservative solution is performed during between about 30 seconds and about 30 minutes.

In an embodiment, the step of contacting the lignocellulosic pieces with the water-based preservative solution is performed during less than about 15 minutes.

In an embodiment, the step of contacting the lignocellulosic pieces with the water-based preservative solution comprises submersing the lignocellulosic pieces in the water-based preservative solution.

In an embodiment, the step of contacting the lignocellulosic pieces with the water-based preservative solution comprises spraying the water-based preservative solution on the lignocellulosic pieces.

In an embodiment, the water-soluble lignocellulosic material preservative comprises borate.

In an embodiment, the borate comprises disodium octaborate tetrahydrate (DOT).

In an embodiment, the process further comprises the step of preparing the water-based preservative solution at a temperature higher than the contact temperature.

In an embodiment, the step of preparing the water-based preservative solution at a temperature higher than the contact temperature comprises preparing the water-based preservative solution at a temperature above about 95° C.

In an embodiment, the process further comprises the step of maintaining the chemically treated lignocellulosic pieces in a post-conditioning environment having a temperature between about 60° C. and about 95° C. and a relative humidity between about 50% and about 100%.

In an embodiment, the steps of contacting the lignocellulosic pieces with the water-based preservative solution and maintaining the chemically treated lignocellulosic pieces in the post-conditioning environment are performed at about atmospheric pressure.

In an embodiment, the step of maintaining the chemically treated lignocellulosic pieces in the post-conditioning environment is performed between during about 30 seconds and about 15 minutes.

In an embodiment, the step of maintaining the chemically treated lignocellulosic pieces in the post-conditioning environment is performed during about 5 minutes and about 12 minutes.

In an embodiment, the step of maintaining the chemically treated lignocellulosic pieces in the post-conditioning environment comprises the substep of exposing the chemically treated lignocellulosic pieces to a water-based post-conditioning agent having a temperature between about 60° C. and about 95° C.

In an embodiment, the post-conditioning agent has a temperature between about 75° C. and about 80° C.

In an embodiment, the post-conditioning agent comprises water vapor.

In an embodiment, a sequence of contacting the lignocellulosic pieces with the water-based preservative solution and maintaining the chemically treated lignocellulosic pieces in the post-conditioning environment is performed a plurality of times.

In an embodiment, the lignocellulosic pieces initially comprise dried and planned lignocellulosic pieces.

In an embodiment, the process further comprises the initial step of maintaining the lignocellulosic pieces in a pre-conditioning environment having a temperature above the ambient temperature and a humidity level above the ambient humidity to heat and humidify the lignocellulosic pieces.

In an embodiment, the step of maintaining the lignocellulosic pieces in a pre-conditioning environment is performed during between about 30 seconds and about 5 minutes.

In an embodiment, the step of maintaining the lignocellulosic pieces in the pre-conditioning environment comprises the substep of exposing the lignocellulosic pieces to a water-based pre-conditioning agent having a temperature between about 70° C. and about 100° C. when in contact with the lignocellulosic pieces.

In an embodiment, the water-based pre-conditioning agent comprises at least one of hot water and water vapor.

In an embodiment, the step of exposing the lignocellulosic pieces to a water-based pre-conditioning agent is performed by submersing the lignocellulosic pieces in hot water.

In an embodiment, the lignocellulosic pieces have a moisture content between about 10 wt % and about 20 wt % before being maintained in the pre-conditioning environment.

According to another general aspect there is also provided a lignocellulosic treatment apparatus for treating lignocellulosic pieces. The lignocellulosic treatment apparatus comprises a process chamber maintained at a temperature between about 60° C. and about 95° C. and a relative humidity between about 50% and about 100%; a preservative solution distribution assembly at least partially located in the process chamber and providing a water-based preservative solution containing a water-soluble lignocellulosic material preservative in a section of the process chamber; and a lignocellulosic piece carrier engaging the lignocellulosic pieces and displacing the same in the process chamber to contact the lignocellulosic pieces with the preservative solution for at least one chemical treatment time period.

In an embodiment, the lignocellulosic piece carrier further maintains the lignocellulosic pieces away from the preservative solution for at least one post-conditioning time period In an embodiment, the preservative solution distribution assembly comprises a preservative solution vat at least partially filled with the water-based preservative solution.

In an embodiment, the apparatus further comprises a lignocellulosic piece support receiving and maintaining a plurality of lignocellulosic pieces in a bundle and wherein the lignocellulosic piece carrier is engageable to the lignocellulosic piece support to displace same in the process chamber. The lignocellulosic piece carrier is sequentially configurable in a submersed configuration where the lignocellulosic piece support is at least partially submersed in the water-based preservative solution contained in the preservative solution vat and a non-submersed configuration where the lignocellulosic piece support is maintained in the process chamber away from the preservative solution vat.

In an embodiment, the lignocellulosic piece support is configured to allow the plurality of lignocellulosic pieces to at least temporarily be in a spaced apart relationship with respect to one another.

In an embodiment, the water-based preservative solution has a contact temperature between about 70° C. and about 95° C. when contacting the lignocellulosic pieces and contains the water-soluble lignocellulosic material preservative in a concentration above about 25% wt.

In an embodiment, the water-based preservative solution has a contact temperature between about 85° C. and about 95° C. when contacting the lignocellulosic pieces.

In an embodiment, the preservative solution contains the water-soluble lignocellulosic material preservative in a concentration between about 40% wt and about 50% wt.

In an embodiment, the preservative solution contains the water-soluble lignocellulosic material preservative in a concentration between about 45% wt and about 47% wt.

In an embodiment, the apparatus further comprises a preservative solution supply in fluid communication with the preservative solution distribution assembly.

In an embodiment, the water-based preservative solution is prepared in the preservative solution supply at a temperature higher than the contact temperature.

In an embodiment, the water-based preservative solution is prepared in the preservative solution supply at a temperature above about 95° C.

In an embodiment, the water-soluble lignocellulosic material preservative comprises borate.

In an embodiment, the borate comprises disodium octaborate tetrahydrate (DOT).

In an embodiment, the process chamber is at about atmospheric pressure.

In an embodiment, the apparatus further comprises a post-conditioning preservative solution distribution assembly located in the process chamber and providing a water-based post-conditioning agent in a section of the process chamber, the lignocellulosic piece carrier displacing the lignocellulosic pieces to expose the lignocellulosic pieces to the post-conditioning agent for a post-conditioning time period.

In an embodiment, the post-conditioning agent has a temperature between about 60° C. and about 95° C.

In an embodiment, the post-conditioning agent has a temperature between about 75° C. and about 80° C.

In an embodiment, the post-conditioning agent comprises water vapor.

In an embodiment, the apparatus further comprises a pre-conditioning preservative solution distribution assembly located in the process chamber and providing a pre-conditioning agent in a section of the process chamber. The lignocellulosic piece carrier displaces the lignocellulosic pieces to expose the lignocellulosic pieces to the pre-conditioning agent for a pre-conditioning time period.

In an embodiment, the pre-conditioning agent has a temperature between about 70° C. and about 100° C. when in contact with the lignocellulosic pieces.

In an embodiment, the pre-conditioning agent comprises hot water.

According to another general aspect, there is also provided another lignocellulosic treatment apparatus for treating lignocellulosic pieces. The lignocellulosic treatment apparatus comprises: a process chamber with a temperature between about 60° C. and about 95° C. and a relative humidity between about 50% and about 100%; a preservative solution vat located in the process chamber and being at least partially filled with a water-based preservative solution containing a water-soluble lignocellulosic material preservative; a lignocellulosic piece support receiving and maintaining a plurality of lignocellulosic pieces in a bundle; and a lignocellulosic piece carrier engageable to the lignocellulosic piece support. The lignocellulosic piece carrier displaces the lignocellulosic piece support in the process chamber and is sequentially configurable in a submersed configuration where the lignocellulosic piece support is at least partially submersed in the water-based preservative solution contained in the preservative solution vat and a non-submersed configuration where the lignocellulosic piece support is maintained in the process chamber away from the preservative solution vat.

In an embodiment, the lignocellulosic piece support is configured to allow the plurality of lignocellulosic pieces to at least temporarily be in a spaced apart relationship with respect to one another.

In an embodiment, the apparatus further comprises a preservative solution supply in fluid communication with the preservative solution distribution assembly.

In an embodiment, the water-based preservative solution is prepared in the preservative solution supply at a temperature higher than the contact temperature.

In an embodiment, the water-based preservative solution is prepared in the preservative solution supply at a temperature above about 95° C.

According to another general aspect, there is further provided another lignocellulosic treatment apparatus for treating lignocellulosic pieces. The lignocellulosic treatment apparatus comprises: a chemical treatment unit comprising a chemical treatment chamber and a preservative solution supply in fluid communication with the chemical treatment chamber, the preservative solution supply supplying the chemical treatment chamber with a water-based preservative solution containing a water-soluble lignocellulosic material preservative; a post-conditioning unit comprising a post-conditioning chamber and a post-conditioning agent supply with a post-conditioning agent heating unit, the post-conditioning agent supply being in fluid communication with the post-conditioning chamber and supplying the post-conditioning chamber with a water-based post-conditioning agent; and at least one lignocellulosic piece carrier displacing the lignocellulosic pieces in the chemical treatment unit and the post-conditioning unit.

In an embodiment, the chemical treatment unit comprises a preservative solution vat at least partially filled with the water-based preservative solution and wherein the at least one lignocellulosic piece carrier is configured to submerse the lignocellulosic pieces in the water-based preservative solution contained in the preservative solution vat.

In an embodiment, the chemical treatment unit comprises a plurality of preservative solution nozzles in fluid communication with the preservative solution supply and projecting the water-based preservative solution in direction of the lignocellulosic pieces carrier to contact lignocellulosic pieces carried thereon.

In an embodiment, the chemical treatment unit comprises a preservative solution outlet to recuperate and return the recuperated water-based preservative solution into the preservative solution supply.

In an embodiment, the post-conditioning unit comprises a plurality of post-conditioning spray nozzles in fluid communication with the post-conditioning agent supply and projecting the post-conditioning agent in direction of the lignocellulosic pieces carrier to contact lignocellulosic pieces carried thereon.

In an embodiment, the post-conditioning unit comprises a post-conditioning agent outlet to recuperate and return the post-conditioning agent to the post-conditioning agent supply.

In an embodiment, the apparatus further comprises: a pre-conditioning unit comprising a pre-conditioning chamber and a pre-conditioning agent supply with a pre-conditioning agent heating unit, the pre-conditioning agent supply being in fluid communication with the pre-conditioning chamber and supplying the pre-conditioning chamber with a water-based pre-conditioning agent. The at least one lignocellulosic piece carrier displaces the lignocellulosic pieces in the pre-conditioning unit, the chemical treatment unit and the post-conditioning unit.

In an embodiment, the pre-conditioning unit comprises a plurality of pre-conditioning spray nozzles in fluid communication with the pre-conditioning agent supply and projecting the water-based pre-conditioning agent in direction of the lignocellulosic piece continuous carrier to contact lignocellulosic pieces carried thereon.

In an embodiment, the pre-conditioning unit comprises a pre-conditioning agent outlet to recuperate the water-based pre-conditioning agent from the pre-conditioning chamber and at least one pipe to return the recuperated water-based pre-conditioning agent into the pre-conditioning agent supply.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the lignocellulosic treatment apparatus and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the lignocellulosic treatment apparatus, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

In the present specification, the term "solution" is intended to include solutions, suspensions (i.e. solutions including solid particles of the lignocellulosic material preservative) or any other suitable liquid-based formulation containing the lignocellulosic material preservative.

Figure 1:
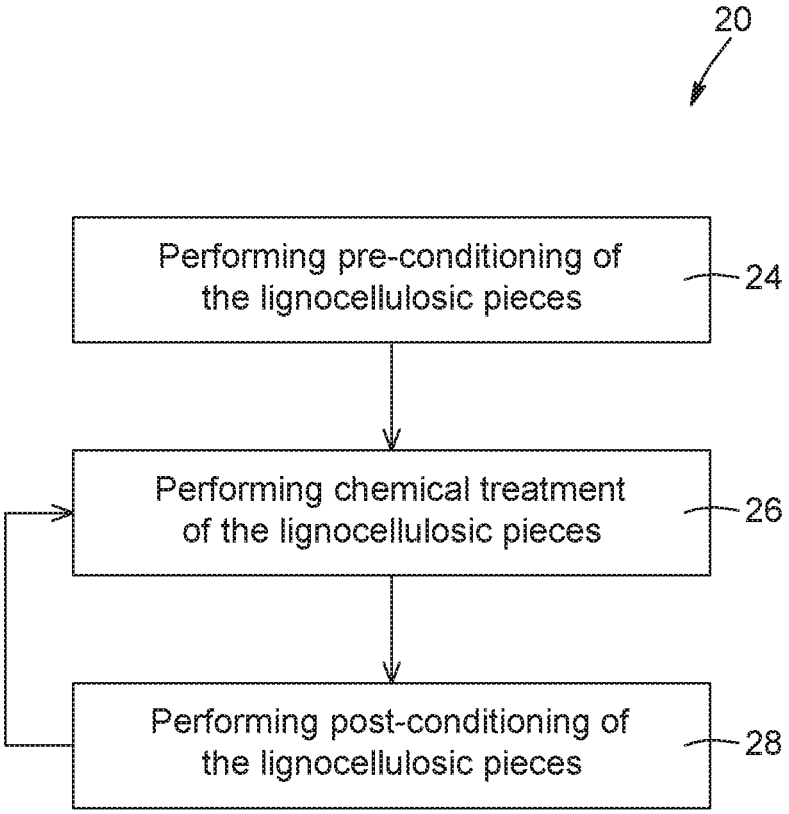
FIG. 1 is a flowchart of steps of a process for treating lignocellulosic pieces according to an embodiment.

Referring to the drawings and, more particularly, referring to FIG. 1, there is shown an embodiment of a lignocellulosic treatment process 20 where lignocellulosic pieces, such as wood pieces, are impregnated with a lignocellulosic material preservative. In the embodiment shown, the process 20 comprises three steps performed sequentially on lignocellulosic pieces, namely a pre-conditioning step 24, a chemical treatment step 26, and a post-conditioning step 28. One skilled in the art will understand that, in an embodiment the sequence including the chemical treatment step 26 and the post-conditioning step 28, can be repeated a number of times.

In an alternative embodiment (not shown), the lignocellulosic treatment process 20 can be free of pre-conditioning step, therefore including only a sequence with the chemical treatment step 26 and the post-conditioning step 28, which once again, can be performed repeatedly a number of times.

The lignocellulosic treatment process 20 is performed on dried and planed lignocellulosic pieces, i.e. lignocellulosic pieces that have been dried and planned, as it is known in conventional lumber production process (not shown). In some embodiments, the lignocellulosic treatment process 20 directly follows planning of the lignocellulosic pieces or is performed after a subsequent classification of the lignocellulosic pieces. In an embodiment, the lignocellulosic pieces have an initial moisture content below about 20 wt %, i.e. before the pre-conditioning step 24 or the chemical treatment step 26 (in the absence of a pre-conditioning step 24). In an alternative embodiment, the lignocellulosic pieces 22 have initial moisture content between about 10 wt % and about 20 wt %.

In an embodiment where a pre-conditioning step 24 is provided, the pre-conditioning step 24 is performed in a preconditioning environment, before the chemical treatment step 26, i.e. before contacting the lignocellulosic pieces with a water-based lignocellulosic material preservative solution, as will be described in more details below. The purpose of the pre-conditioning step 24 is to increase the moisture content and the temperature of a superficial layer of the lignocellulosic pieces, i.e. a layer extending inwardly from the outer surface of the lignocellulosic pieces towards the core of a thickness reaching about 5 mm, thereby promoting the forthcoming diffusion of the water-based lignocellulosic material preservative solution into the lignocellulosic pieces during the subsequent chemical treatment step 26. More particularly, in an embodiment, humidifying and heating the lignocellulosic pieces, i.e. maintaining the lignocellulosic pieces in a pre-conditioning environment having a temperature above the ambient temperature and a humidity level above the ambient humidity, increases the preservative quantity that diffuses into the lignocellulosic pieces during the following chemical treatment step 26.

In an embodiment, during the pre-conditioning step 24, the lignocellulosic pieces 22 are in contact with a water-based pre-conditioning agent, such as warm or hot water. In an embodiment, the temperature of the water-based pre-conditioning agent is above the ambient temperature when in contact with the lignocellulosic pieces. For instance, in an embodiment, the water-based pre-conditioning agent has a temperature of about 70° C. to about 100° C., when in contact with the lignocellulosic pieces. In an alternative embodiment, the water-based pre-conditioning agent has a temperature of about 75° C. to about 95° C. when in contact with the lignocellulosic pieces. In an embodiment, the pre-conditioning step 24 is performed at about atmospheric pressure. In such an embodiment, during the pre-conditioning step 24, a portion of the water-based pre-conditioning agent is absorbed by the lignocellulosic pieces.

In an embodiment, the pre-conditioning step 24 is performed for a time period of between about 30 seconds and about 5 minutes. One skilled in the art will understand that, in an alternative embodiment, the pre-conditioning step 24 can be performed during a shorter or longer time period. Furthermore, the temperature of the pre-conditioning agent can differ from the above-mentioned temperatures.

In an embodiment, following the pre-conditioning step 24, the moisture content of the lignocellulosic pieces in the superficial layer is increased of between about 1 wt % and about 10 wt %. Hence, in an embodiment, the moisture content of the lignocellulosic pieces following the pre-conditioning step 24 is above about 20% wt and the temperature in the superficial layer ranges between about 75° C. and about 95° C.

In embodiments where a pre-conditioning step 24 is provided, the chemical treatment step 26 is performed subsequently to the pre-conditioning step 24. The chemical treatment step 26 is performed anteriorly to the post-conditioning step 28. During the chemical treatment step 26, the lignocellulosic pieces are impregnated with a water-soluble lignocellulosic material preservative, i.e. a lignocellulosic material preservative contained in a water-based lignocellulosic material preservative solution in contact with the lignocellulosic pieces. When in contact with the lignocellulosic pieces, the water-based lignocellulosic material preservative solution diffuses towards a core of the lignocellulosic pieces. The migration of the lignocellulosic material preservative from a surface of the lignocellulosic pieces towards the core occurs through diffusion, i.e. a migration from a region of high concentration, i.e. the surface of the lignocellulosic pieces, to a region of low concentration, i.e. the core of the lignocellulosic pieces. More particularly, the lignocellulosic material preservative diffuses into the lignocellulosic material by the effect referred to as "chemical osmotic pressure through open ring pores". In an embodiment, the chemical treatment step 26 is performed at about atmospheric pressure.

In an embodiment, the lignocellulosic material preservative comprises borate, such as disodium octaborate tetrahydrate (DOT) and/or a borate alkaline salt. One skilled in the art will understand that, in an alternative embodiment, the lignocellulosic material preservative can also comprise other preservatives such as, without being limitative, Zinc Borate, Diammonium Phosphate (DAP), organophosphorus ester, or the like.

In an embodiment, the water-based preservative solution has a preservative concentration above about 25 wt % and, in an embodiment, between about 25% wt and about 50% wt. In an alternative embodiment, the preservative concentration is between about 40% wt and about 50% wt. In an embodiment, the preservative concentration is between about 45% wt and about 47% wt.

Furthermore, in an embodiment, in order to increase the dissolution of the lignocellulosic material preservative in water and promote diffusion, the temperature of the water-based lignocellulosic material preservative solution is above the ambient temperature when in contact with the lignocellulosic pieces. In an embodiment, the temperature of the water-based lignocellulosic material preservative solution ranges between about 70° C. and about 95° C. when in contact with the lignocellulosic pieces. In an embodiment, the temperature of the water-based lignocellulosic material preservative solution ranges between about 85° C. and about 95° C. when in contact with the lignocellulosic pieces 22. In an embodiment, the temperature of the water-based lignocellulosic material preservative solution ranges between about 90° C. and about 95° C. when in contact with the lignocellulosic pieces 22

In an embodiment, in order to further increase the dissolution of the lignocellulosic material preservative in water, the temperature of the water-based lignocellulosic material preservative solution is initially brought up to a temperature higher than the above mentioned contact temperatures during preparation of the solution and the solution is subsequently cooled slightly, to reach the above mentioned temperature ranges, before the water-based lignocellulosic material preservative solution is in contact with the lignocellulosic pieces. In an embodiment, the temperature of the water-based lignocellulosic material preservative solution is initially brought up to above 95° C. and, more particularly close to 100° C. during preparation of the solution. Thus, the concentration of the preservative in the solution is slightly higher than the solubility of the preservative at the contact temperature when in contact with the lignocellulosic pieces.

In an embodiment, the chemical treatment step 26 is performed during about 30 seconds to about 30 minutes. In an embodiment, the chemical treatment step 26 is performed during less than about 15 minutes and, more particularly during about 10 minutes. However, one skilled in the art will understand that, in an alternative embodiment, the chemical treatment step 26 can be performed during a shorter or longer time period. Furthermore, the temperature of the water-based preservative solution can vary from the embodiment described above. It is appreciated that the contact time period between the lignocellulosic pieces and the water-based preservative solution during the chemical treatment step 26 can be adjusted in accordance with the size and the type of the lignocellulosic pieces being treated.

The lignocellulosic treatment process 20 further comprises the post-conditioning step 28, which is performed subsequently to the chemical treatment step 26.

The post-conditioning step 28 prevents the precipitation of the lignocellulosic material preservative on the outer surface of the lignocellulosic pieces, which occurs when the temperature of the lignocellulosic pieces reaches about 55° C. (at a preservative concentration of about 47% wt), and reduces water evaporation from the lignocellulosic pieces. When precipitation of the lignocellulosic material preservative occurs, a thin solid preservative layer can be observed on the outer surface of the lignocellulosic pieces, such as a substantially thin solid white layer when DOT is used as lignocellulosic material preservative.

In an embodiment, the post-conditioning step 28 is performed in a warm and humid gaseous atmosphere, such as in a humidity controlled heated environment. For instance, in an embodiment, the post-conditioning step 28 is performed in a post-conditioning environment with a temperature between about 60° C. and about 95° C. and a relative humidity between about 50% and about 100%. One skilled in the art will understand that, performing the post-conditioning step 28 in a warm and humid post-conditioning environment, results in water evaporation from the lignocellulosic pieces being reduced and solubility of the water-based lignocellulosic material preservative being maintained for a sufficient time period to allow the diffusion of the preservative towards the core of the lignocellulosic pieces 22.

In an embodiment, during the post-conditioning step 28, the lignocellulosic pieces are also in contact with a water-based post-conditioning agent. In an embodiment, the temperature of the water-based post-conditioning agent 46 is above the ambient temperature when in contact with the lignocellulosic pieces. For instance and without being limitative, in an embodiment, the water-based post-conditioning agent 46 has a temperature of about 60° C. to about 95° C., when in contact with the lignocellulosic pieces. In an alternative embodiment, the water-based post-conditioning agent 46 has a temperature of about 75° C. to about 80° C. In an embodiment, the water-based post-conditioning agent 46 comprises water vapor. In an embodiment, the post-conditioning step 28 is performed at about atmospheric pressure.

In an embodiment, the post-conditioning step 28 is performed during about 30 seconds to about 15 minutes. In an embodiment, the post-conditioning step 28 is performed during about between 8 minutes and 12 minutes and, more particularly, during about 10 minutes. One skilled in the art will understand that, in an alternative embodiment, the post-conditioning step 28 can be performed during a shorter or longer time period. Furthermore, the temperature of the post-conditioning agent can differ from the above-mentioned temperatures.

The lignocellulosic treatment process 20 having been described above, apparatuses configured to perform the lignocellulosic treatment process 20 will now be described in more details below.

Referring to FIGS. 2*a* to 2*i*, an embodiment of a lignocellulosic treatment apparatus 49 for carrying out the above-described lignocellulosic treatment process 20 is shown. In the embodiment shown, the lignocellulosic treatment apparatus 49 includes a housing 29 defining a process chamber 30. In FIGS. 2*a* to 2*i*, the walls of the housing 29 are represented as being transparent for viewing the apparatus inside the process chamber 30. The lignocellulosic treatment apparatus 49 also includes a chemical treatment vat 33, a lignocellulosic piece support 37 engaging and supporting lignocellulosic pieces 22, and a lignocellulosic piece carrier 38 operatively engageable to the lignocellulosic piece support 37 for displacement thereof. The chemical treatment vat 33 is contained in the process chamber 30 and the lignocellulosic piece carrier 38 conveys the lignocellulosic pieces inside the process chamber 30.

In an embodiment, the lignocellulosic piece support 37 is configured to support a plurality of grouped lignocellulosic pieces 22 in a spaced-apart relationship, such as to allow the flow of liquid, such as the water-based preservative solution, therebetween. Furthermore, the lignocellulosic piece support 37 also includes an outer support structure 37*a* maintaining the plurality of lignocellulosic pieces 22 grouped together to form a bundle. One skilled in the art will understand that, in the embodiment shown, the lignocellulosic piece support 37 maintains the lignocellulosic pieces 22 in a substantially horizontal configuration, but that in an alternative embodiment, the lignocellulosic piece support 37 can maintain the lignocellulosic piece 22 in a different orientation, such as substantially vertically or the like.

For example and without being limitative, in an embodiment, the lignocellulosic piece support 37 includes one or more substantially horizontal spacer (not shown), such as for example and without being limitative, a strip of wood, metal or the like, between each rows of lignocellulosic piece 22. Similarly, in an embodiment, at least one substantially vertical spacer (not shown), can also be provided between each column of lignocellulosic piece 22. In an alternative, no spacer can be provided between the lignocellulosic pieces 22, the lignocellulosic piece support 37 rather allowing a slight movement of the lignocellulosic pieces 22 to temporarily define spaces therebetween and thereby allows liquid to flow therein when the lignocellulosic piece support 37 is agitated, as will be described in more details below.

In the embodiment shown, the lignocellulosic piece carrier 38 includes a support engagement assembly 41 engageable, from above, to the lignocellulosic piece support 37. The support engagement assembly 41 is operatively connected to a driving mechanism 43 including an horizontal displacement mechanism 43*a* and a vertical displacement mechanism 43*b*, respectively allowing a substantially horizontal and substantially vertical displacement of the support engagement assembly 41 and the corresponding grouped lignocellulosic pieces 22 maintained in the lignocellulosic piece support 37 engaged to the support engagement assembly 41. In the embodiment shown, the horizontal displacement mechanism 43*a* includes a translatable carriage 53 driven by a belt and pulley system 55 and the vertical displacement mechanism 43*b* includes connecting bars 57 extending between the translatable carriage 53 and the support engagement assembly 41 and translatable vertically between a raised configuration (See FIGS. 2*a*, 2*c*, 2*d*, 2*f*, 2*g* and 2*i*) and a lowered configuration (See FIGS. 2*b*, 2*e* and 2*h*) with regards to the translatable carriage 53. One skilled in the art will understand that, in an alternative embodiment, the horizontal displacement mechanism 43*a* and vertical displacement mechanism 43*b* can differ from the embodiment shown.

The process chamber 30 is a substantially closed chamber defined by the housing 29, where the humidity level and temperature can be substantially controlled, with a lignocellulosic pieces entry port 30*a* and a lignocellulosic pieces exit port 30*b* allowing the lignocellulosic piece support 37 to be respectively moved inwardly and outwardly of the process chamber 30. For example and without being limitative, the lignocellulosic pieces entry port 30*a* and lignocellulosic pieces exit port 30*b* can include a slideable wall section, a pivotable wall section, or the like (not shown) mounted to walls of the housing 29. In an embodiment, the temperature in the process chamber is between about 60° C. and about 95° C. and the relative humidity is between about 50% and about 100%.

In view of the above, in order to perform the above described optional pre-conditioning step 24, the chemical treatment step 26 and the post-conditioning step 28, the apparatus operates such that the lignocellulosic piece support 37 containing the lignocellulosic pieces 22 is initially brought inside the process chamber 30, the support engagement assembly 41 engages the lignocellulosic piece support 37, the lignocellulosic piece support 37 is displaced inside the process chamber 30 by the lignocellulosic piece carrier 38 according to a predetermined displacement sequence and the lignocellulosic piece support 37 containing the lignocellulosic pieces 22 is finally brought outside of the process chamber 30.

FIGS. 2*a* to 2*d* show the lignocellulosic piece support 37 being successively brought into the process chamber 30, engaged by the support engagement assembly 41 and moved over the chemical treatment vat 33, through displacement of the lignocellulosic piece carrier 38. In an embodiment where a pre-conditioning step 24 is performed, the lignocellulosic piece support 37 can be maintained inside the process chamber 30, for example aside or over the chemical treatment vat 33 (see FIGS. 2*c* and 2*d*), for a pre-conditioning time period, such that the lignocellulosic pieces 22 are heated and humidified before the lignocellulosic piece support 37 is lowered into the chemical treatment vat 33 (see FIG. 2*e*). In such an embodiment, steps shown in FIGS. 2*a* to 2*d* can be part of the pre-conditioning step 24 and the displacement and speed of the lignocellulosic piece carrier 38 can be adjusted accordingly.

In an alternative embodiment (not shown), the apparatus 49 can include a pre-conditioning solution vat containing the pre-conditioning agent, and the lignocellulosic piece support 37 can be lowered into the pre-conditioning solution vat to perform the pre-conditioning step 24, rather than simply being maintained in the process chamber 30. In such an embodiment, the lignocellulosic piece support 37 can consequently be brought above the pre-conditioning solution vat by the lignocellulosic piece carrier 38 and the connecting bars 57 of the vertical displacement mechanism 43*b* can be temporarily configured in the lowered configuration, such that the lignocellulosic pieces 22 contained in the lignocellulosic piece support 37 are immersed/submersed into a pre-conditioning solution contained in the pre-conditioning solution vat for the pre-conditioning time period, before being brought out of it.

In an alternative embodiment where no pre-conditioning step 24 is performed, the lignocellulosic piece support 37 can be lowered into the chemical treatment vat 33, such that the lignocellulosic pieces 22 are submersed in the water-based preservative solution 42 (see FIG. 2*e*), without delay, i.e. without being maintained in the process chamber 30 and/or without being immersed in the pre-conditioning solution vat, in order to be heated and humidified before the chemical treatment step 26.

Figure 2A:
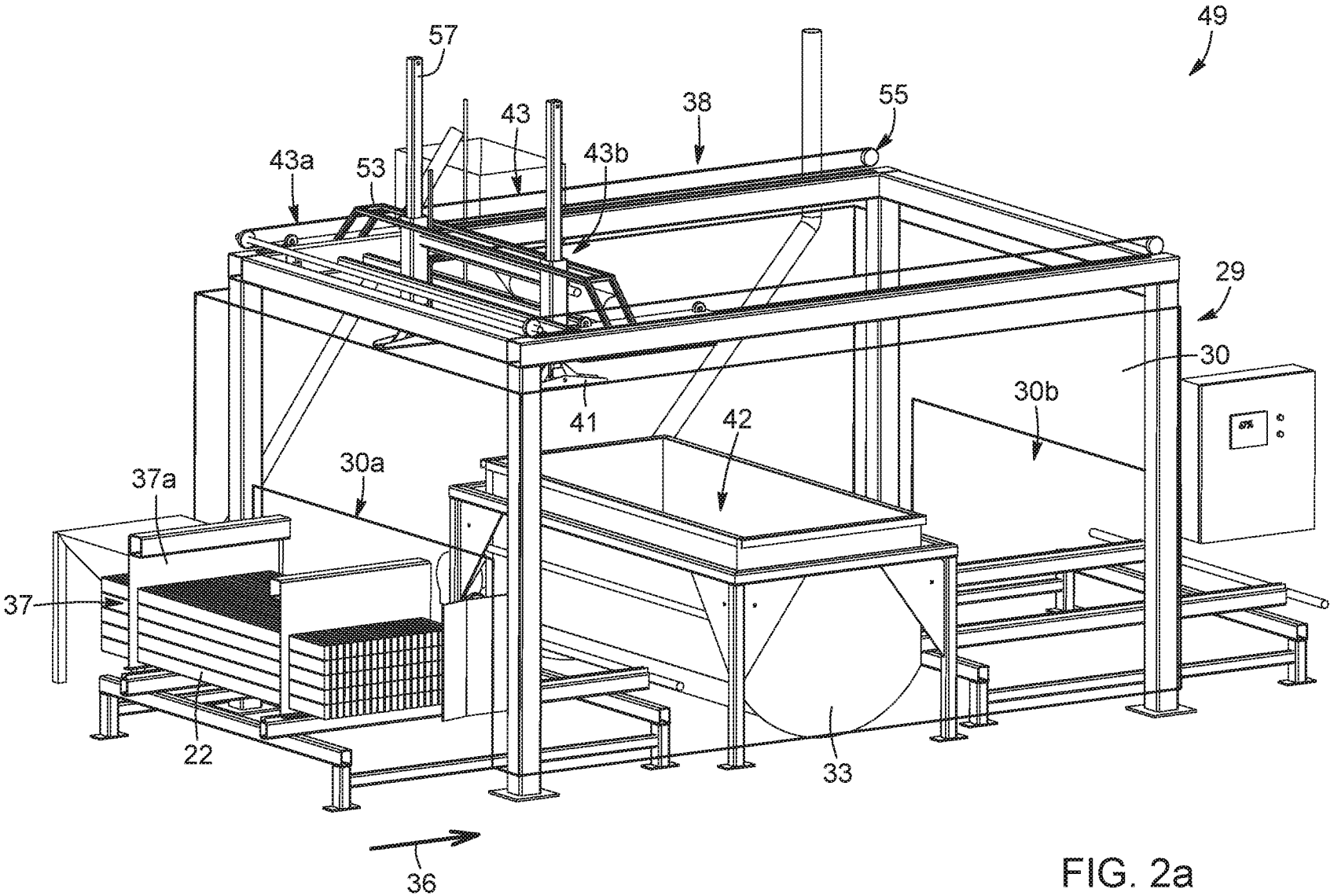
FIGS. 2*a* to 2*i* are perspective views of a sequence of operation of an apparatus for treating lignocellulosic material, in accordance with an embodiment where the apparatus includes a single unit and the lignocellulosic pieces are immersed in a preservative solution vat.
Figure 2B:
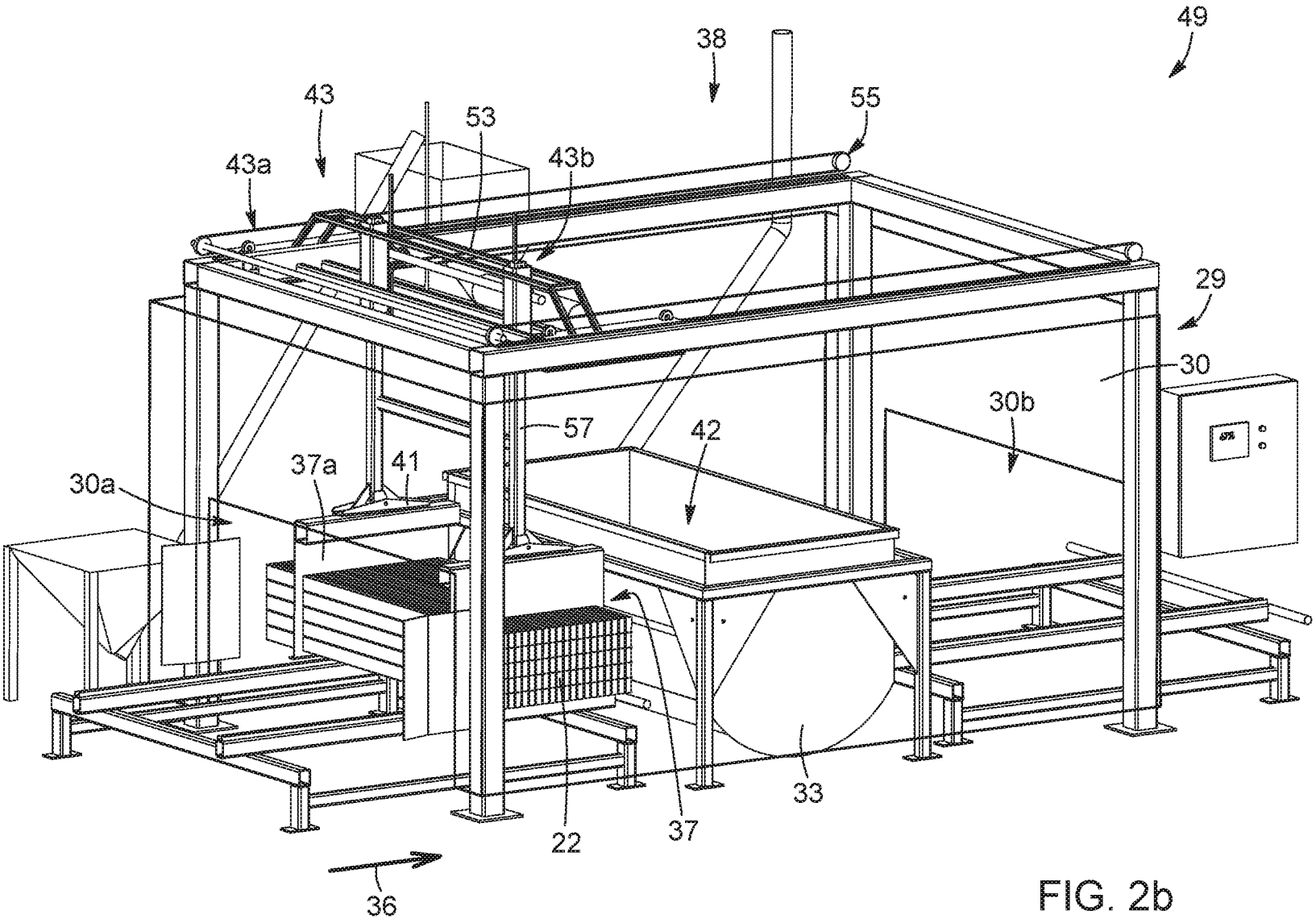
Figure 2C:
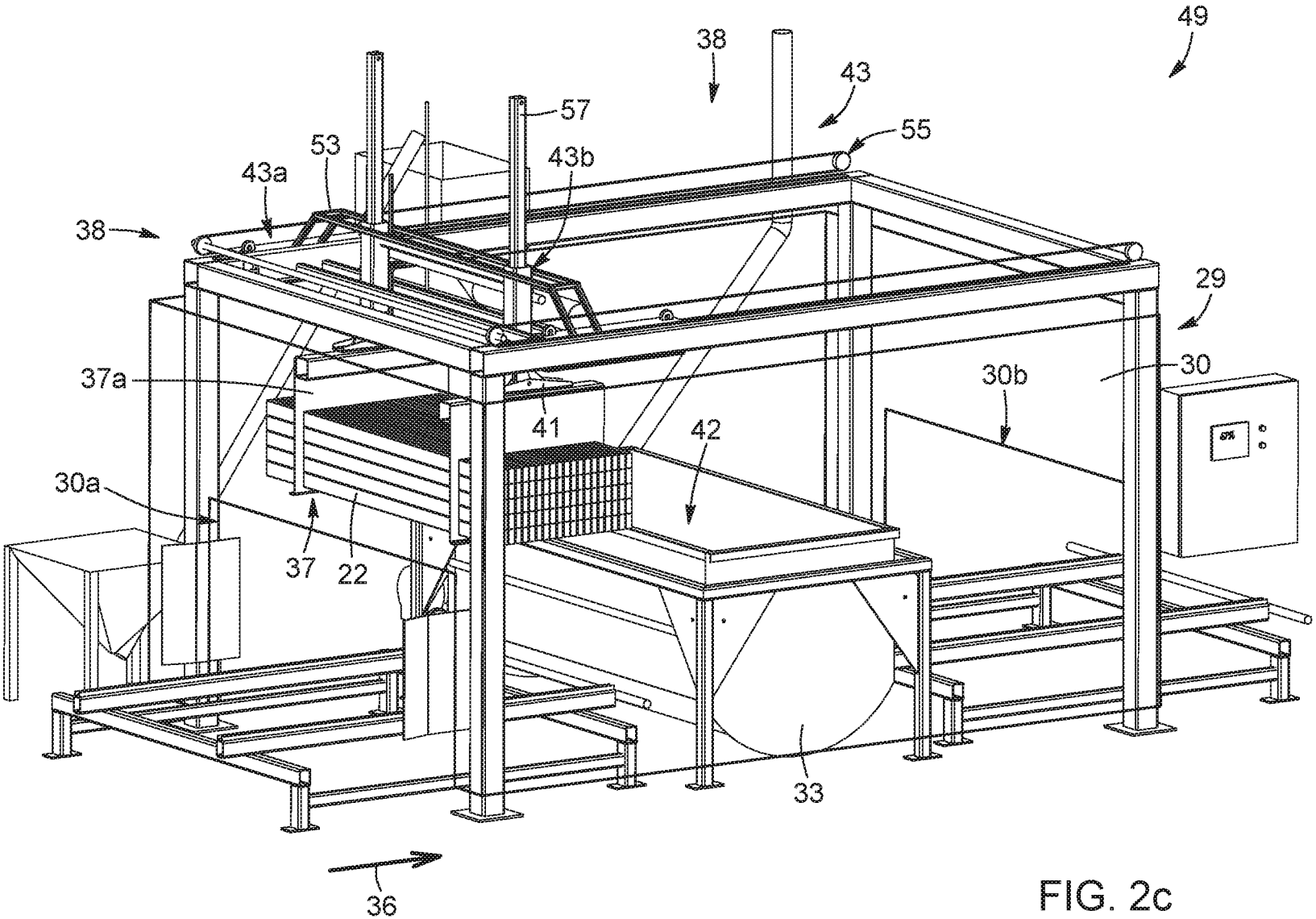
Figure 2D:
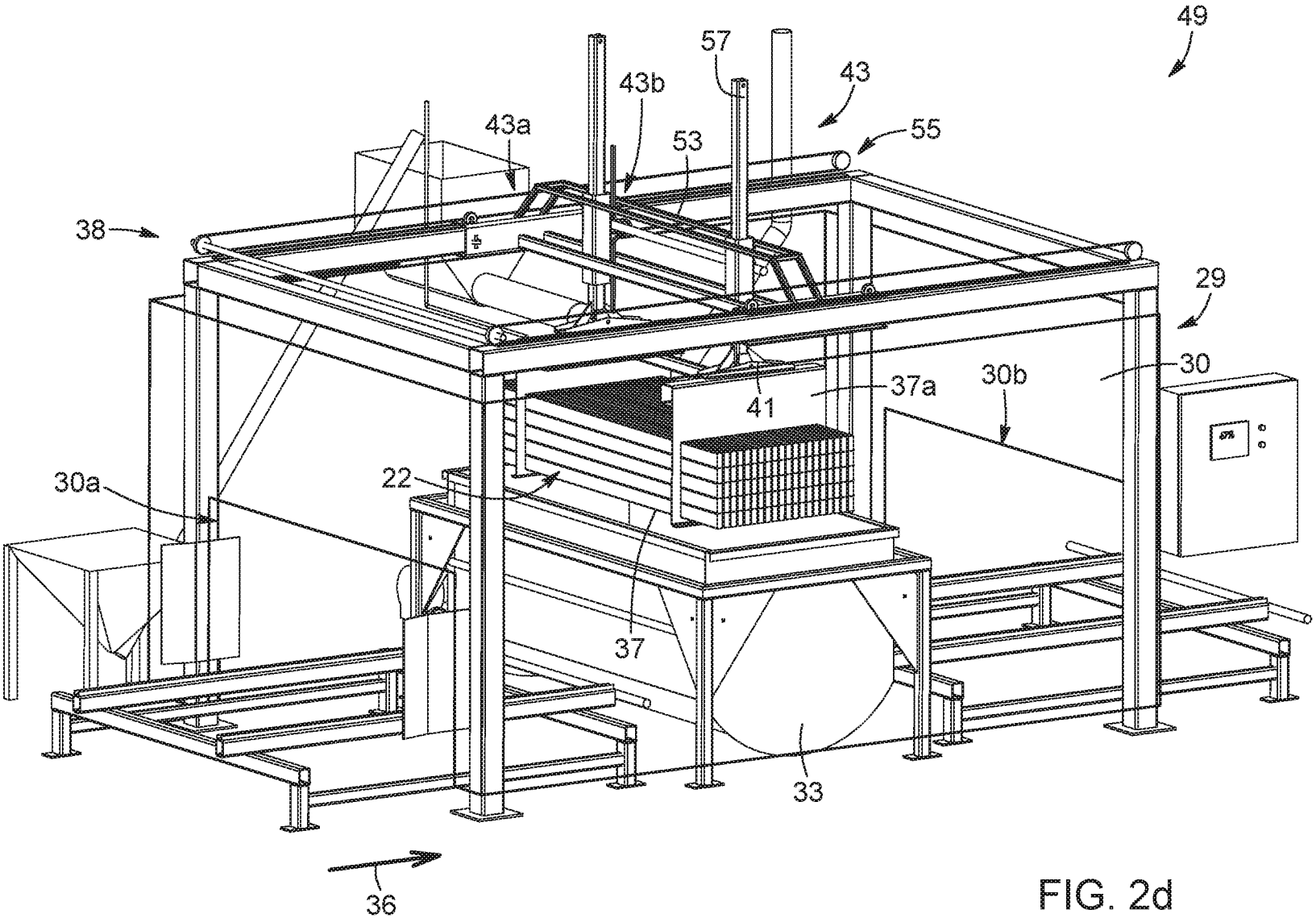
Figure 2E:
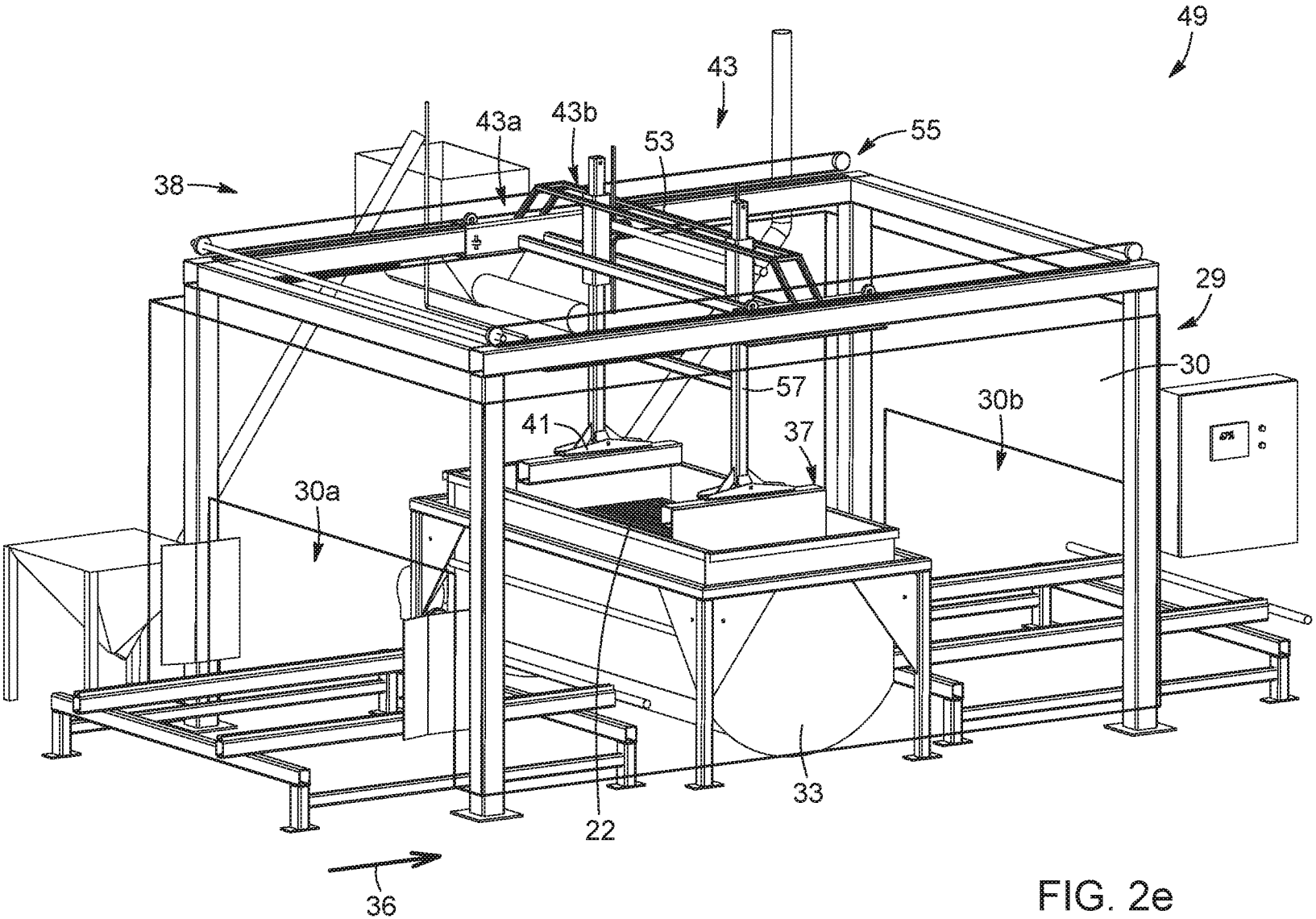

FIG. 2*e* shows the connecting bars 57 of the vertical displacement mechanism 43*b* being lowered and the carrier 38 being configured in a submersed configuration, such that the lignocellulosic piece support 37 is lowered into the chemical treatment vat 33 operating as solution distribution assembly, and the lignocellulosic pieces 22 are submersed in the water-based preservative solution 42 contained therein. The lignocellulosic piece support 37 is maintained inside the chemical treatment vat 33 during a chemical treatment time period, in order to perform the chemical treatment step 26. As mentioned above, in an embodiment, the temperature of the water-based preservative solution 42 is maintained between about 70° C. and about 95° C. and more particularly between about 85° C. and about 95° C., and even more particularly between about 90° C. and about 95° C. In an embodiment, the lignocellulosic piece support 37 is maintained inside the chemical treatment vat 33 for a chemical treatment time period between about 30 seconds and 30 minutes and more particularly about 10 minutes. In an embodiment, the lignocellulosic piece support 37 is agitated by the lignocellulosic piece carrier 38, while being maintained in the submersed configuration, to allow the water-based preservative solution 42 to flow between the lignocellulosic pieces 22.

In an alternative embodiment (not shown), the chemical treatment vat 33 can have an elongated configuration such that the lignocellulosic piece support 37 can be displaced substantially horizontally by the lignocellulosic piece carrier 38 when in the submersed configuration.

To control the temperature and the concentration of lignocellulosic material preservative contained in the water-based preservative solution 42 and compensate for the preservative solution 42 absorbed by the lignocellulosic pieces 22, fresh preservative solution 42 (including recycled preservative solution 42) can be supplied, continuously or discontinuously, in the chemical treatment vat 33. In an embodiment, the fresh preservative solution 42 is provided from a preservative solution supply in fluid communication therewith, such as a preservative solution preparation tank, which will be described in more details below with regards to FIG. 10. One skilled in the art will understand that the preservative concentration and/or the temperature of the water-based preservative solution 42 can be controlled and adjusted in the preservative solution supply before being supplied to the chemical treatment vat 33. Preservative solution 42 can also be withdrawn from the chemical treatment vat 33, through a preservative solution outlet (not shown), to be recycled and/or prevent the preservative solution 42 to overflow.

In an embodiment, the apparatus 49 can include a heating assembly (not shown) to control the temperature of the water based preservative solution 42 in the chemical treatment vat 33. For example and without being limitative, the heating assembly can have a section extending in the chemical treatment vat 33 or close to the chemical treatment vat 33 and configured to heat, directly or indirectly, the water based preservative solution 42 contained therein.

Figure 2F:
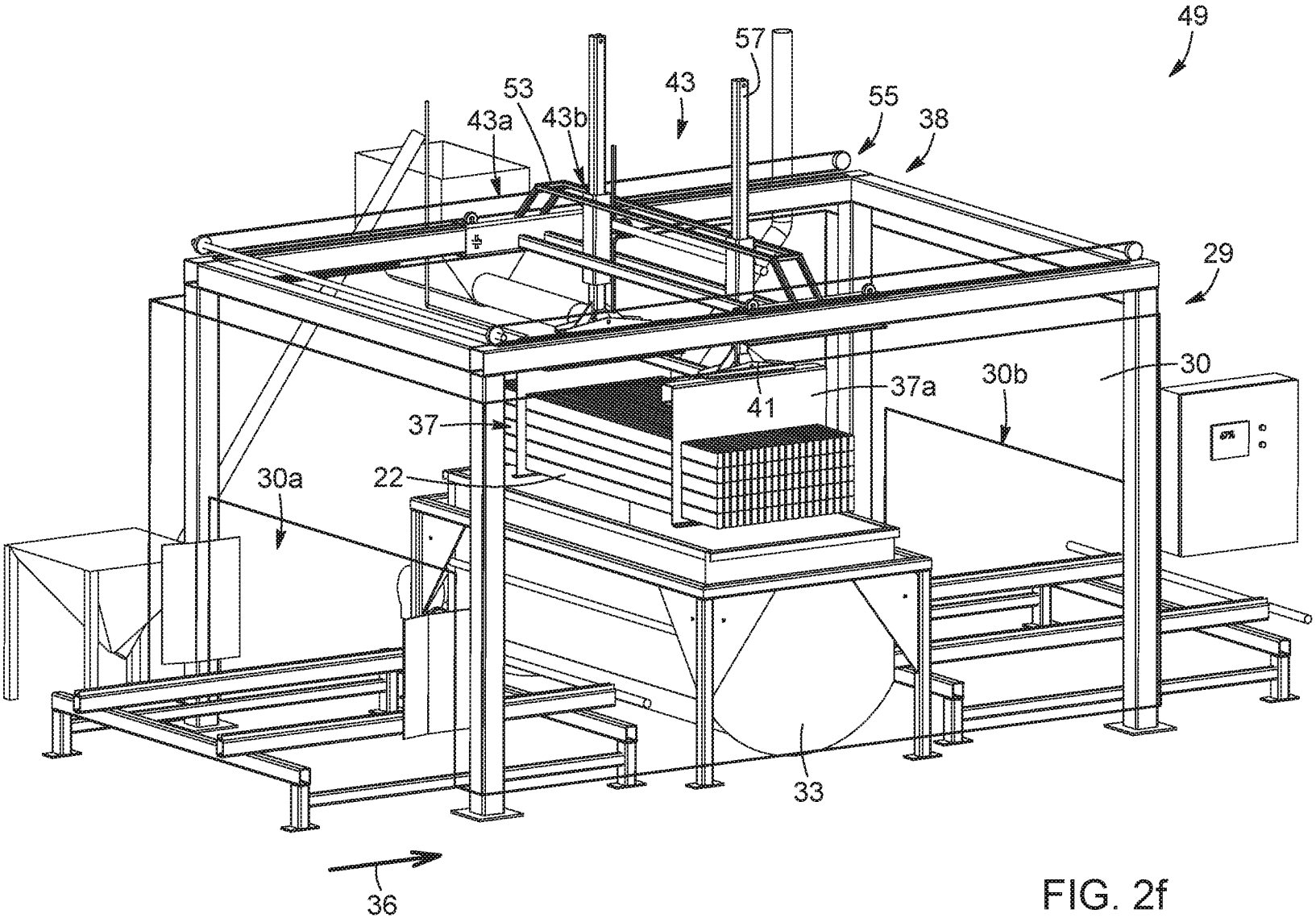

FIG. 2*f* shows the connecting bars 57 of the vertical displacement mechanism 43*b* being raised and the carrier 38 being configured in a non-submersed configuration, such that the lignocellulosic piece support 37 is removed from the chemical treatment vat 33 and maintained thereabove. The lignocellulosic piece support 37 is maintained inside the process chamber 30 in the non-submersed configuration, for example over the chemical treatment vat 33, during a post-conditioning time period, in order to perform the post-conditioning step 28. As mentioned above, in an embodiment, the temperature in the process chamber is between about 60° C. and about 95° C. and the relative humidity is between about 50% and about 100% in order to prevent the precipitation of the lignocellulosic material preservative on the outer surface of the lignocellulosic pieces 22 during the post-conditioning step 28. In an embodiment, the lignocellulosic piece support 37 is maintained inside the process chamber 30 during about 30 seconds to about 15 minutes, and more particularly during about 8 minutes to about 12 minutes, and even more particularly during about 10 minutes.

In an embodiment, the lignocellulosic treatment apparatus 49 can perform the steps shown in FIGS. 2*e* and 2*f* a plurality of times, thereby repeatedly performing the chemical treatment step 26 followed by the post-conditioning step 28. For example and without being limitative, in an embodiment, the chemical treatment step 26 followed by a post-conditioning step 28 can be repeated twice, three times or four times.

Figure 2G:
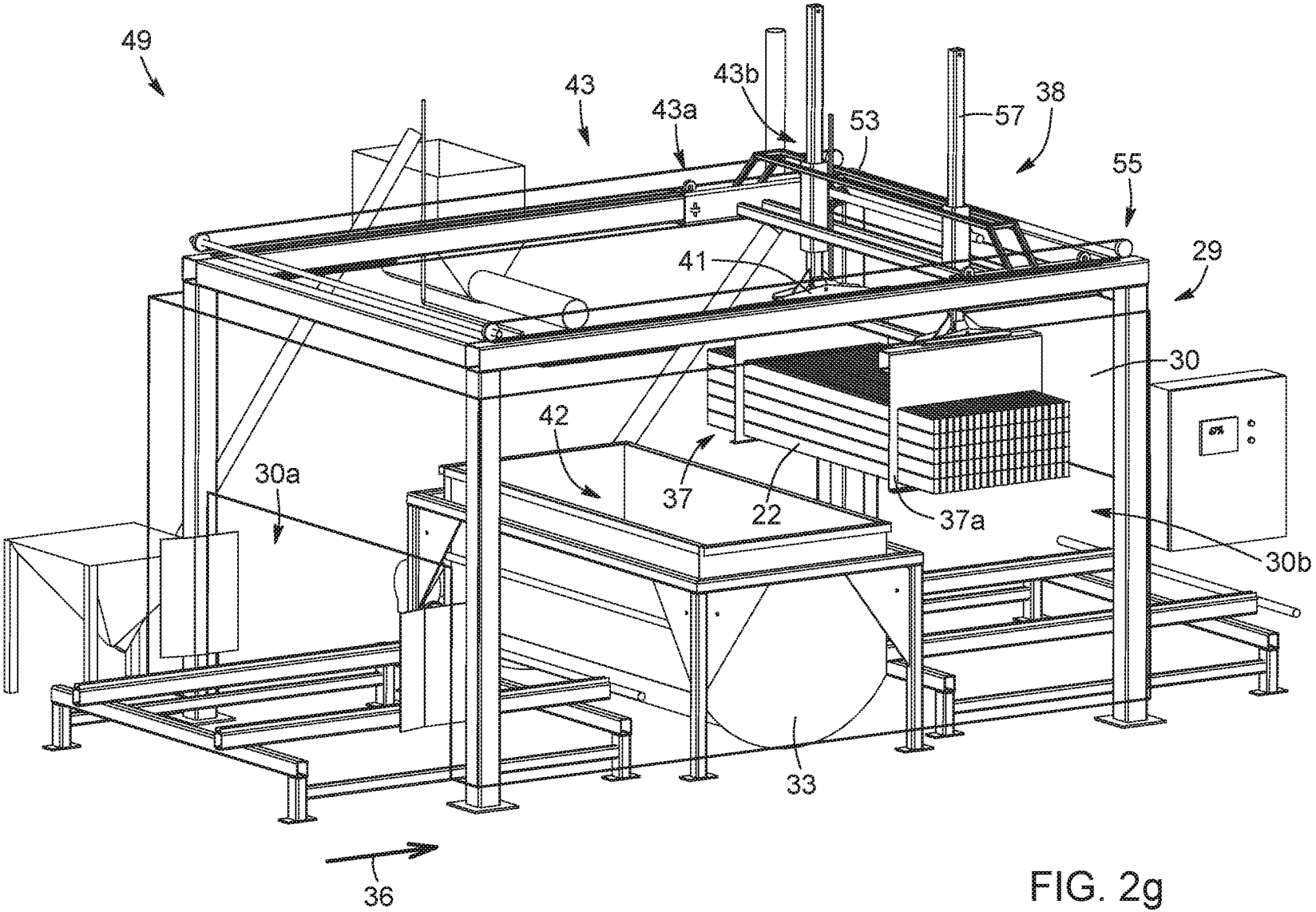
Figure 2H:
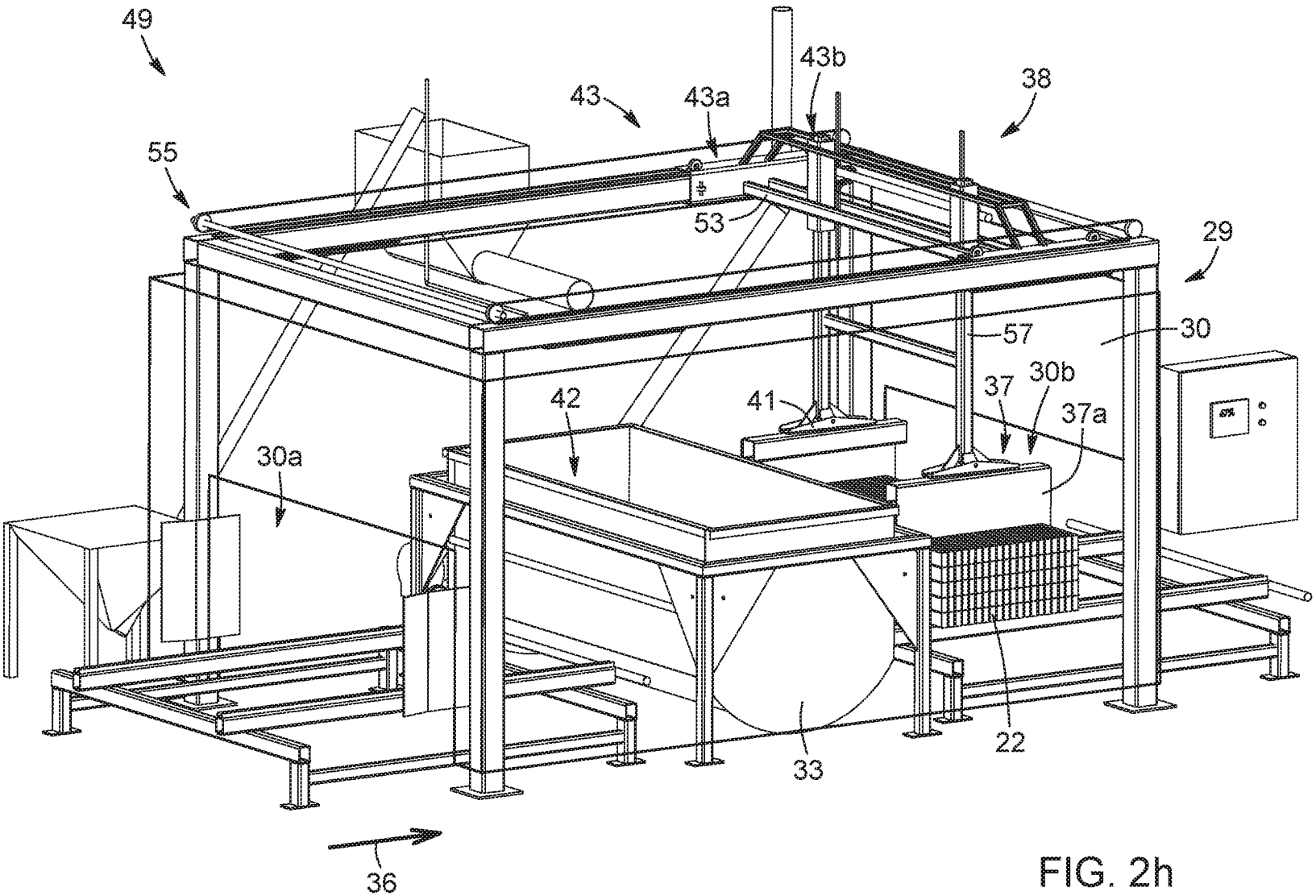
Figure 2I:
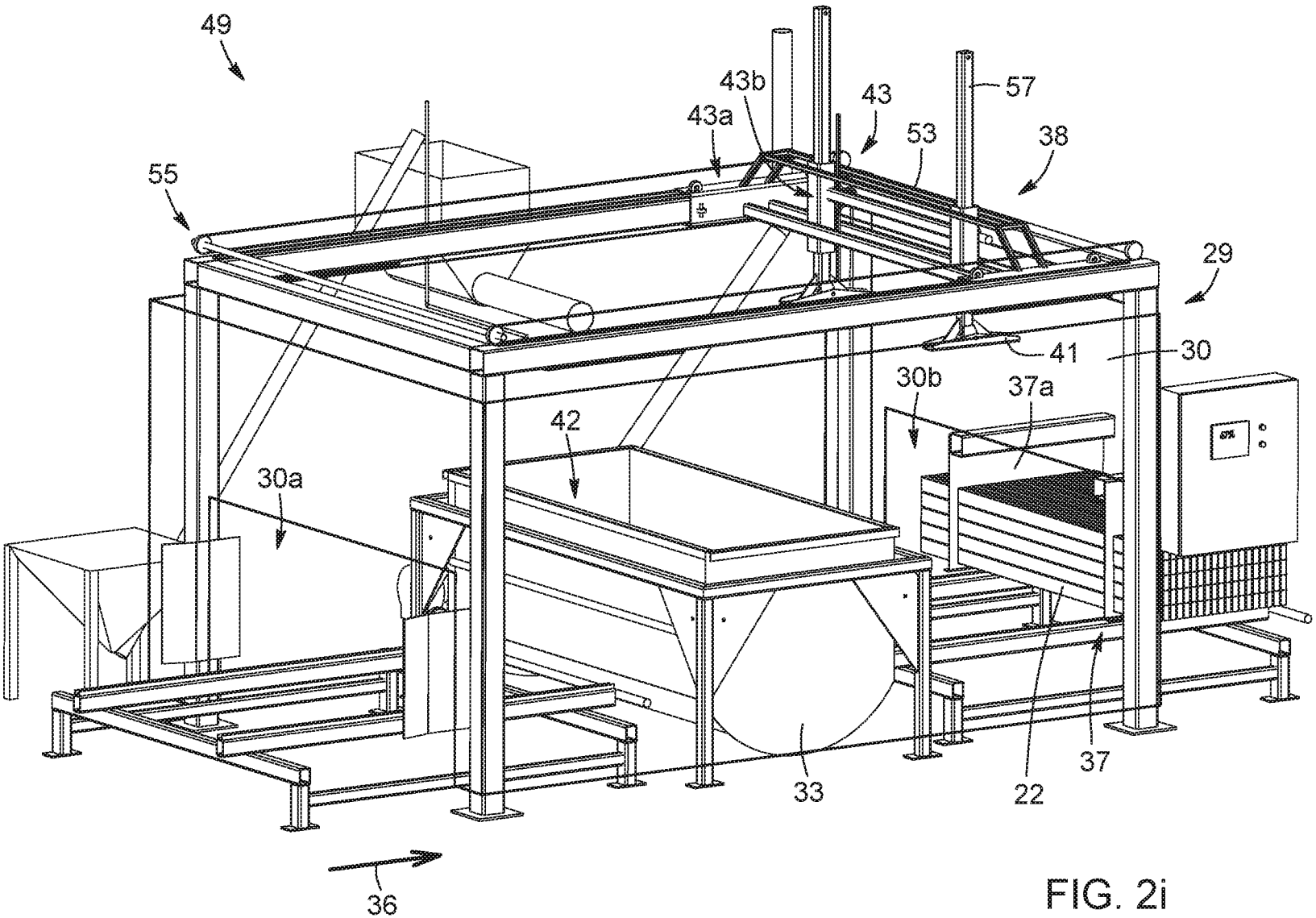
Figure 3:
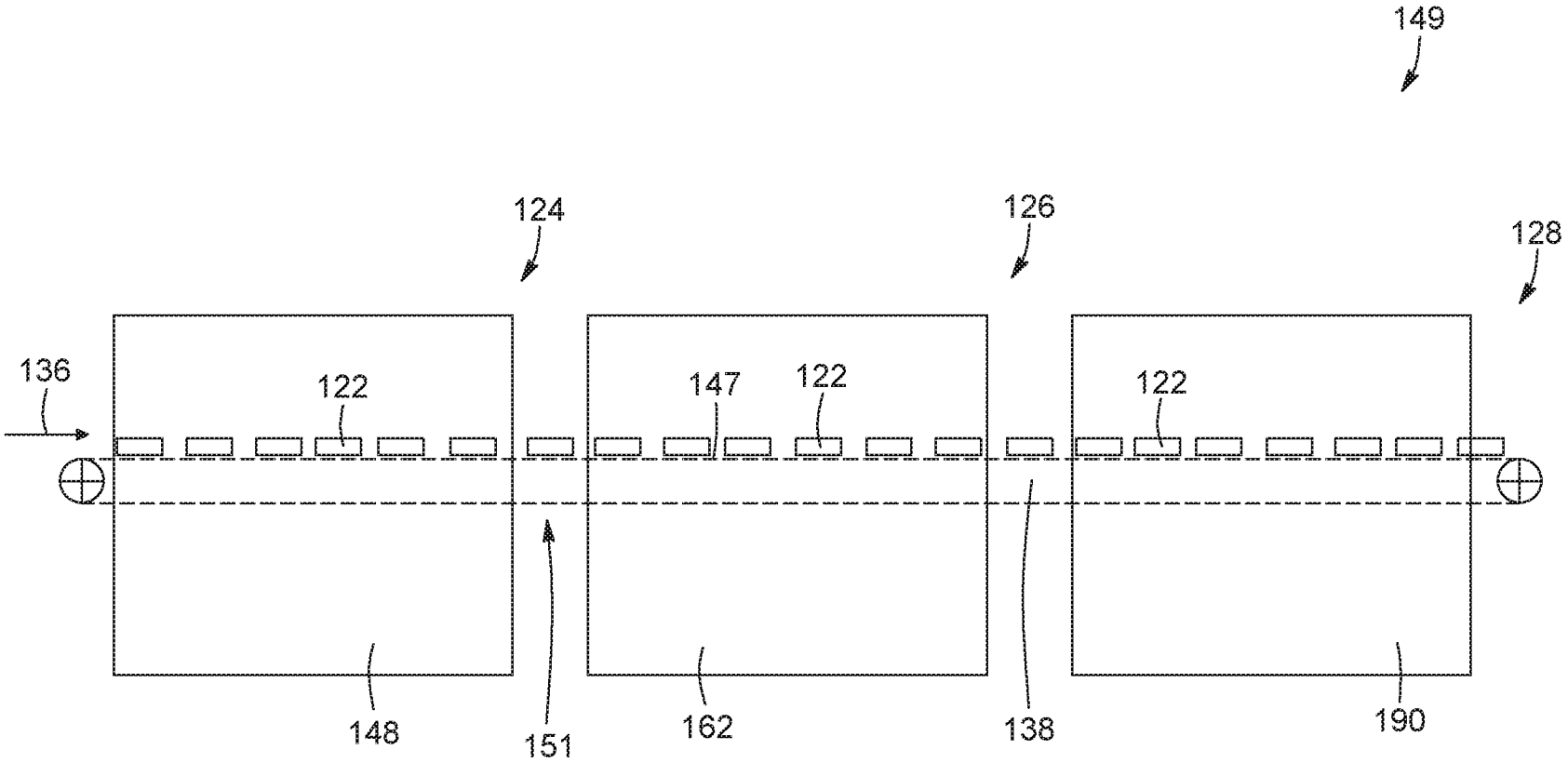
FIG. 3 is a schematic cross-section view of an apparatus for treating lignocellulosic material in accordance with an embodiment where the apparatus includes multiple units.

FIGS. 2*g* to 2*i* show the lignocellulosic piece support 37 being successively moved from over the chemical treatment vat 33 through displacement of the lignocellulosic piece carrier 38, disengaged from the support engagement assembly 41 and moved outside of the process chamber 30. In an embodiment, steps shown in FIGS. 2*g* and 2*h* can also be part of the post-conditioning step 28, and the speed of the lignocellulosic piece carrier 38 can be adjusted accordingly.

In the embodiment shown in FIGS. 2*a* to 2*i*, the lignocellulosic pieces 22 are sequentially conveyed in the direction of arrow 36 in the apparatus 49, through displacement of the bundle of lignocellulosic pieces 22 contained in the lignocellulosic piece support 37 by the lignocellulosic piece carrier 38. In the embodiment shown, the lignocellulosic pieces 22 are disposed substantially perpendicularly to the direction of arrow 36. One skilled in the art will however understand that, in an alternative embodiment, the lignocellulosic pieces 22 can also be disposed substantially parallel to the direction of arrow 36 or at an oblique angle with respect to the direction of arrow 36.

Now referring to FIGS. 3 to 5 and 7, there is shown alternative embodiments of the lignocellulosic treatment apparatus 49 for carrying out the above-described lignocellulosic treatment process 20, where similar features are referenced with similar reference number in the 100 series. In the embodiment shown, each one of the pre-conditioning step 124, chemical treatment step 126 and post-conditioning step 128 is performed in a corresponding unit, respectively the pre-conditioning unit 148, the chemical treatment unit 162, and the post-conditioning unit 190. As mentioned above, in an alternative embodiment, the apparatus 149 can be free of pre-conditioning unit 148.

In the embodiment shown, the lignocellulosic pieces 122 are conveyed through the apparatus 149 by a single continuous lignocellulosic piece carrier 138, such as a conveyor, extending continuously in the apparatus 149. The lignocellulosic piece carrier 138 defines a production line 151 of the apparatus 149. One skilled in the art will however understand that, in an alternative embodiment (not shown), the production line 151 can include a plurality of carriers 138, mounted in series, with piece exchanged assemblies, extending therebetween, and operative to transfer the lignocellulosic pieces 122 from an upstream carrier to a downstream carrier. In the embodiment shown in FIG. 3, the lignocellulosic pieces 122 are conveyed in the direction of arrow 136 through the three different steps 124, 126 and 128. In an embodiment, the lignocellulosic pieces 122 are disposed in a spaced-apart configuration on a carrying surface 147 of the carrier 138. However, one skilled in the art will understand that, in an alternative embodiment, the lignocellulosic pieces 122 can be disposed differently, such as and without being limitative, stacked one on top of the other, set in bundle with spacers between each row of lignocellulosic pieces 122, or the like. In the embodiment shown, the lignocellulosic pieces 122 are once again disposed substantially perpendicular to the direction of arrow 136. One skilled in the art will, once again understand that, in an alternative embodiment, the lignocellulosic pieces 122 can also be disposed substantially parallel to the direction of arrow 136 or at an oblique angle with respect to the direction of arrow 136.

Figure 4:
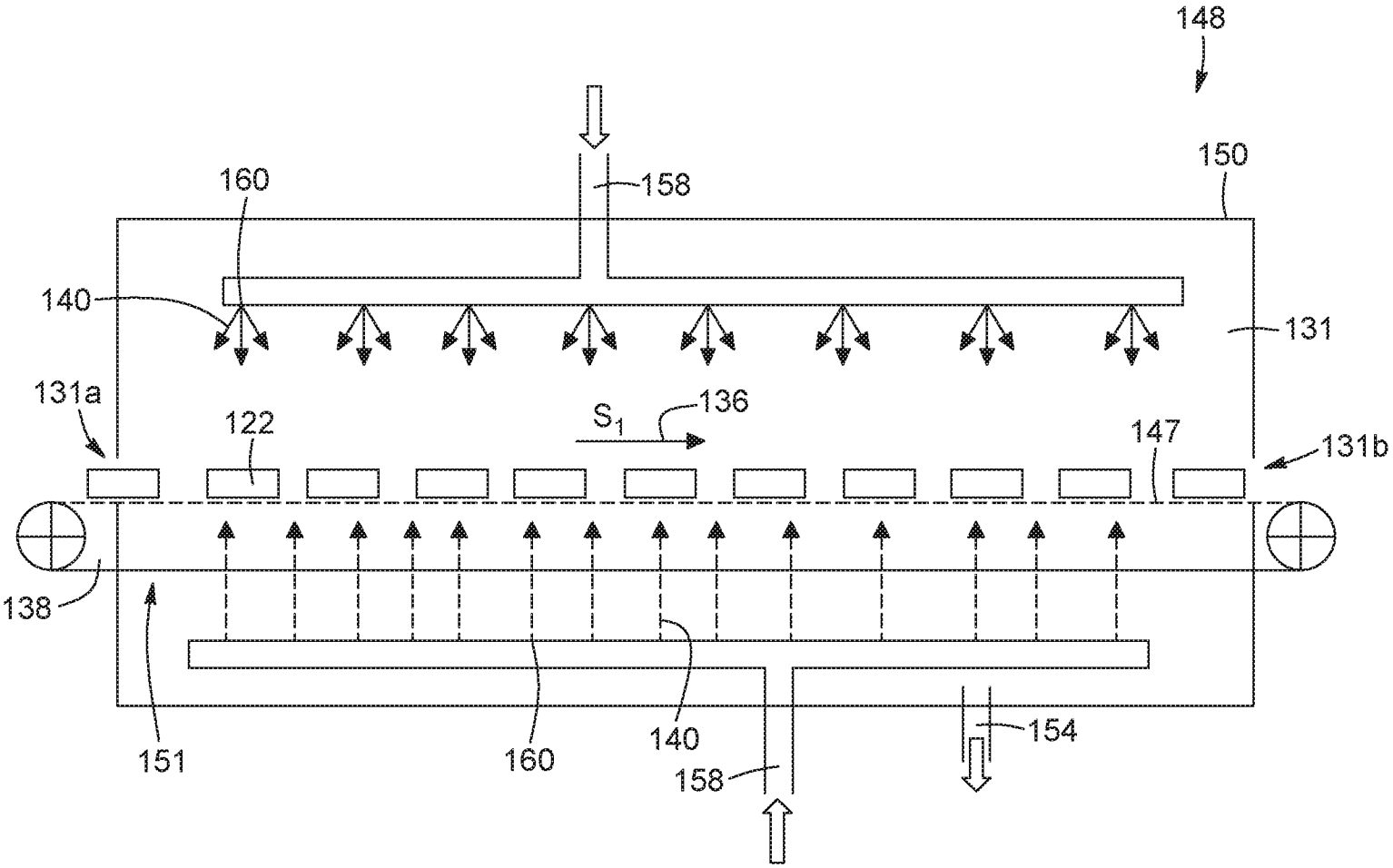
FIG. 4 is a schematic cross-section view of a pre-conditioning unit of the apparatus of FIG. 3 for carrying out a pre-conditioning step of the lignocellulosic treatment process, in accordance with an embodiment.

In reference to FIG. 4, there is shown an embodiment of the pre-conditioning unit 148, which comprises a housing 150 defining the pre-conditioning chamber 131 in which the pre-conditioning step 124 is performed. The housing 150 comprises a pre-conditioning piece entry port 131*a* and a pre-conditioning piece exit port 131*b*, through which the lignocellulosic pieces 122 respectively continuously ingress into the pre-conditioning chamber 131, where the pre-conditioning step 124 is performed, and egress from the pre-conditioning chamber 131. In the embodiment shown, the housing 150 comprises a pre-conditioning agent outlet 154, which will be described in more details below.

In an alternative embodiment (not shown), the pre-conditioning unit 148 can be free of pre-conditioning chamber 131. More particularly, the pre-conditioning step 124 can be performed without an enclosed space.

In the embodiment shown, the continuous lignocellulosic piece carrier 138 extends through the pre-conditioning chamber 131 and through the pre-conditioning piece entry port 131*a* and the pre-conditioning piece exit port 131*b*. The lignocellulosic pieces 122 are disposed on the carrying surface 147 of the carrier 138, outside the pre-conditioning chamber 131, and conveyed continuously in the pre-conditioning chamber 131. In an embodiment, the speed ($s_1$) of the continuous lignocellulosic piece carrier 138 is adjustable and can be adjusted to control the residence time of the lignocellulosic pieces 122 in the pre-conditioning chamber 131. In the embodiment shown, the lignocellulosic pieces 122 are continuously conveyed in the direction of arrow 136 on the carrying surface 147 of the carrier 138.

As mentioned above, during the pre-conditioning step 124, the lignocellulosic pieces 122 is humidified and heated with the water-based pre-conditioning agent 140. The pre-conditioning unit 148 comprises a pre-conditioning agent supply 158 in fluid communication with the pre-conditioning chamber 131. The pre-conditioning agent supply 158 comprises a pre-conditioning agent heating unit (not shown) to heat the water-based pre-conditioning agent 140, to a temperature above the ambient temperature.

In the embodiment shown, the pre-conditioning agent supply 158 comprises a plurality of pre-conditioning spray nozzles 160 positioned in the pre-conditioning chamber 131 above and under the carrier 138. Thus, in the embodiment shown, the upper and lower surfaces of the lignocellulosic pieces 122 are in contact with the water-based pre-conditioning agent 140. The pre-conditioning spray nozzles 160 are oriented to spray the pre-conditioning agent 140 towards the carrying surface 147 of the carrier 138. In an alternative embodiment (not shown), only one of the upper and lower surfaces of the lignocellulosic pieces 122 can be in contact with the water-based pre-conditioning agent 140.

In an alternative embodiment, it is appreciated that the pre-conditioning chamber 131 can comprise, in addition to or instead of the pre-conditioning spray nozzles 160, different distribution assemblies, such as a plurality of sprinklers, a set of hoses, one or more perforated pipes, or the like. Furthermore, the shape and the configuration of the preservative solution distribution assembly can differ from the pre-conditioning spray nozzles 160 schematically shown in FIG. 4. In an alternative embodiment, the carrier 138 can comprise a rotatable device to which the lignocellulosic pieces 122 are mounted and being engaged in rotation to expose all the faces of the lignocellulosic pieces 122 to the pre-conditioning agent 140.

One skilled in the art will also understand that, in an alternative embodiment, assemblies different than the above described pre-conditioning agent supply 158 can also be provided for controlling the temperature and relative humidity in the pre-conditioning chamber 131. For example and without being limitative, in an alternative embodiment (not shown), the pre-conditioning agent supply 158 can include a reservoir at least partially filled with heated water. In an embodiment, a section of the carrier 138 extends into the reservoir containing the heated water to temporarily immerse or submerse the lignocellulosic pieces 122 therein. In another embodiment, the reservoir can be positioned below the carrier 138 such that the conveyed lignocellulosic pieces 122 are heated and humidified by the vapor generated from the heated water. In another embodiment, any known heat and/or humidity control device, in fluid communication with the pre-conditioning chamber 131, can also be used to control the temperature and/or relative humidity in the pre-conditioning chamber 131.

In the pre-conditioning chamber 131, a portion of the supplied water-based pre-conditioning agent 140 is absorbed by the lignocellulosic pieces 122 while a remaining portion reaches gravitationally the pre-conditioning agent outlet 154 and is recovered and can be recycled (or reused) in the process. More particularly, the recovered portion of the water-based pre-conditioning agent 140 can be returned, directly or indirectly, to the pre-conditioning agent supply 158 to be reinjected into the pre-conditioning chamber 131.

Figure 5:
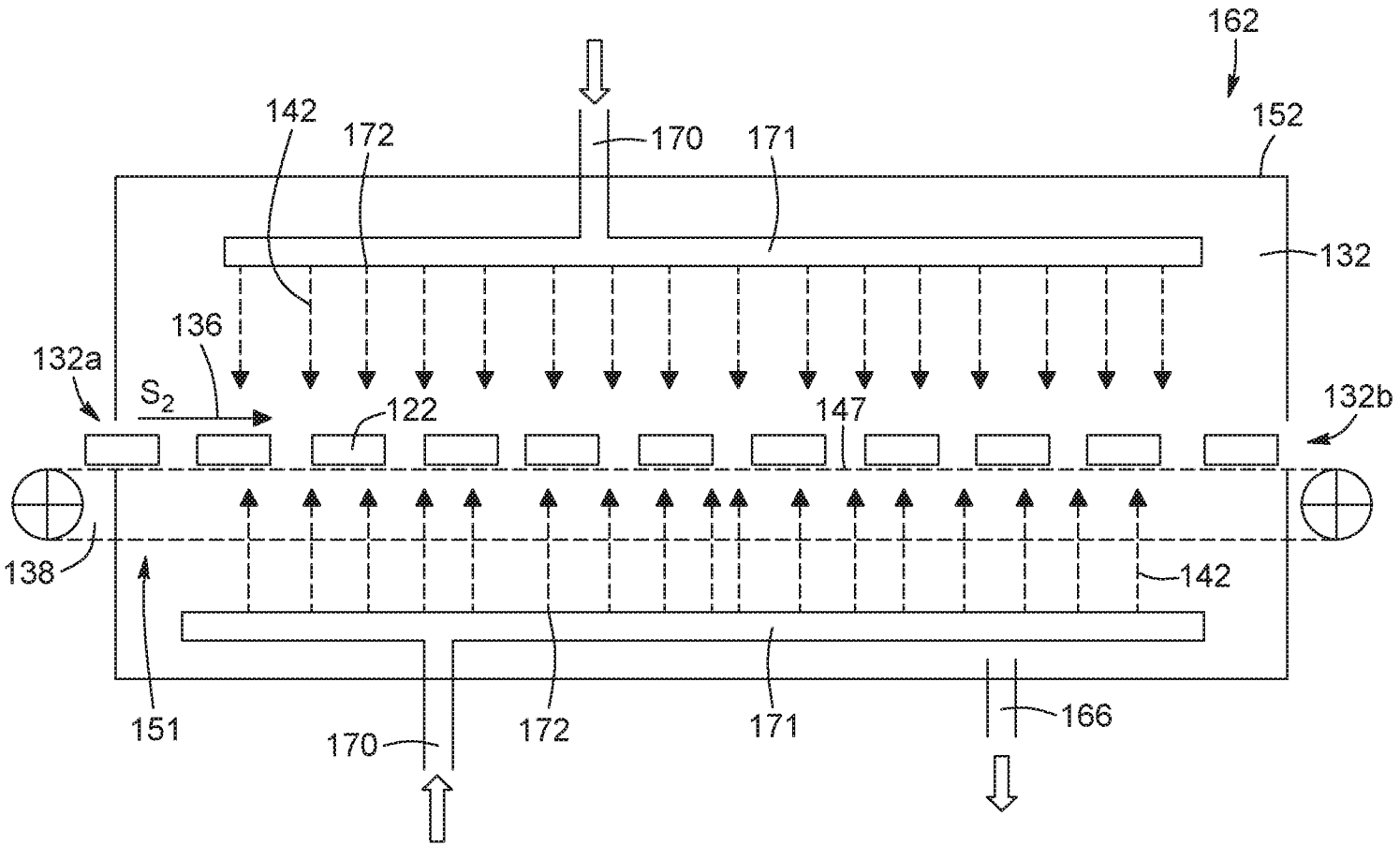
FIG. 5 is a schematic cross-section view of a chemical treatment unit of the apparatus of FIG. 3 for carrying out a chemical treatment step of the lignocellulosic treatment process, in accordance with an embodiment, wherein a preservative solution is sprayed on lignocellulosic pieces.

In reference to FIG. 5, there is shown an embodiment of the chemical treatment unit 162, which comprises a housing 152 defining the chemical treatment chamber 132 in which the chemical treatment step 126 is performed. The housing 152 comprises a chemical treatment piece entry port 132*a* and a chemical treatment piece exit port 132*b* through which the lignocellulosic pieces 122 respectively continuously ingress to the chemical treatment chamber 132, where the chemical treatment step 126 is performed, and egress from the chemical treatment chamber 132. The housing 152 further comprises a preservative solution outlet 166, which will be described in more details below.

In an alternative embodiment (not shown), the chemical treatment unit 162 can be free of chemical treatment chamber 132. More particularly, the chemical treatment step 126 can be performed without any enclosed space.

Similarly to the above-described pre-conditioning unit 148, the continuous lignocellulosic piece carrier 138 extends through the chemical treatment chamber 132, including the chemical treatment piece entry port 132*a* and the chemical treatment piece exit port 132*b*. The carrier 138 can be the same carrier as the one extending through the pre-conditioning unit 148 or it can be another carrier mounted serially with the carrier 138 extending through the pre-conditioning unit 148. As for the pre-conditioning unit 148, the lignocellulosic pieces 122 are disposed on the carrying surface 147 of the carrier 138, and conveyed continuously in the chemical treatment chamber 132 in the direction of arrow 136. In an embodiment, the speed ($s_2$) of the continuous lignocellulosic piece carrier 138 is adjustable and can be adjusted to control the residence time of the lignocellulosic pieces 122 in the chemical treatment chamber 132. In an embodiment (not shown) where the carriers extending in the pre-conditioning unit 148 and the chemical treatment unit 162 are different carriers, the speed ($s_1$) of the carrier extending in the pre-conditioning unit 148 can be different from the speed ($s_2$) of the carrier extending in the chemical treatment unit 162.

As mentioned above, during the chemical treatment step 126, the lignocellulosic pieces 122 are impregnated with the water-soluble lignocellulosic material preservative provided in the water-based preservative solution 142. In the embodiment shown, the chemical treatment unit 162 comprises a preservative solution supply 170 in fluid communication with the chemical treatment chamber 132 for providing the water-based preservative solution 142 to the lignocellulosic pieces 122.

In the embodiment shown, the preservative solution supply 170 is in fluid communication with preservative solution distribution headers 171 positioned in the chemical treatment chamber 132 respectively above and under the carrier 138. Each one of the preservative solution distribution headers 171 comprises a plurality of preservative solution nozzles 172 projecting the water-based preservative solution 142 respectively downwardly and upwardly towards the lignocellulosic pieces 122 carried on the carrying surface 147 of the carrier 138. Thus, in the embodiment shown, the water-based preservative solution 142 is applied to the upper and lower surfaces of the lignocellulosic pieces. In an alternative embodiment (not shown), the water-based preservative solution 142 can be applied to only one of the upper and lower surfaces of the lignocellulosic pieces 122, i.e. the chemical treatment unit 162 can comprise only one preservative solution distribution header 171. It is also appreciated that, in an alternative embodiment, the assembly for distributing the water-based preservative solution 142 can differ in shape and configuration from the preservative solution distribution headers 171 schematically shown in FIG. 5. For example and without being limitative, in an alternative embodiment (not shown), the preservative solution distribution assembly can include a supply basin having a perforated bottom surface through which the preservative solution 142 gravitationally dribbles on the conveyed lignocellulosic pieces 122, a plurality of sprinklers, a set of hoses, one or more perforated pipes, or the like.

In the embodiment shown, the preservative solution headers 171 are aligned with the production line 151 in the direction of arrow 136. In an alternative embodiment, the preservative solution headers 171 can be disposed perpendicularly to the direction of arrow 136 or at an oblique angle with respect to the direction of arrow 136.

In the chemical treatment chamber 132, a portion of the supplied water-based preservative solution 142 is absorbed by the lignocellulosic pieces 122. The remaining portion reaches gravitationally the preservative solution outlet 166 and is recovered and can be recycled (or reused) in the process. More particularly, the recovered portion of the preservative solution 142 can be returned, directly or indirectly to the preservative solution supply 170 to be reinjected into the chemical treatment chamber 132. As mentioned above, the preservative concentration and/or the temperature of the recovered preservative solution 142 can be controlled and adjusted before being reinjected into the chemical treatment chamber 132.

Figure 6:
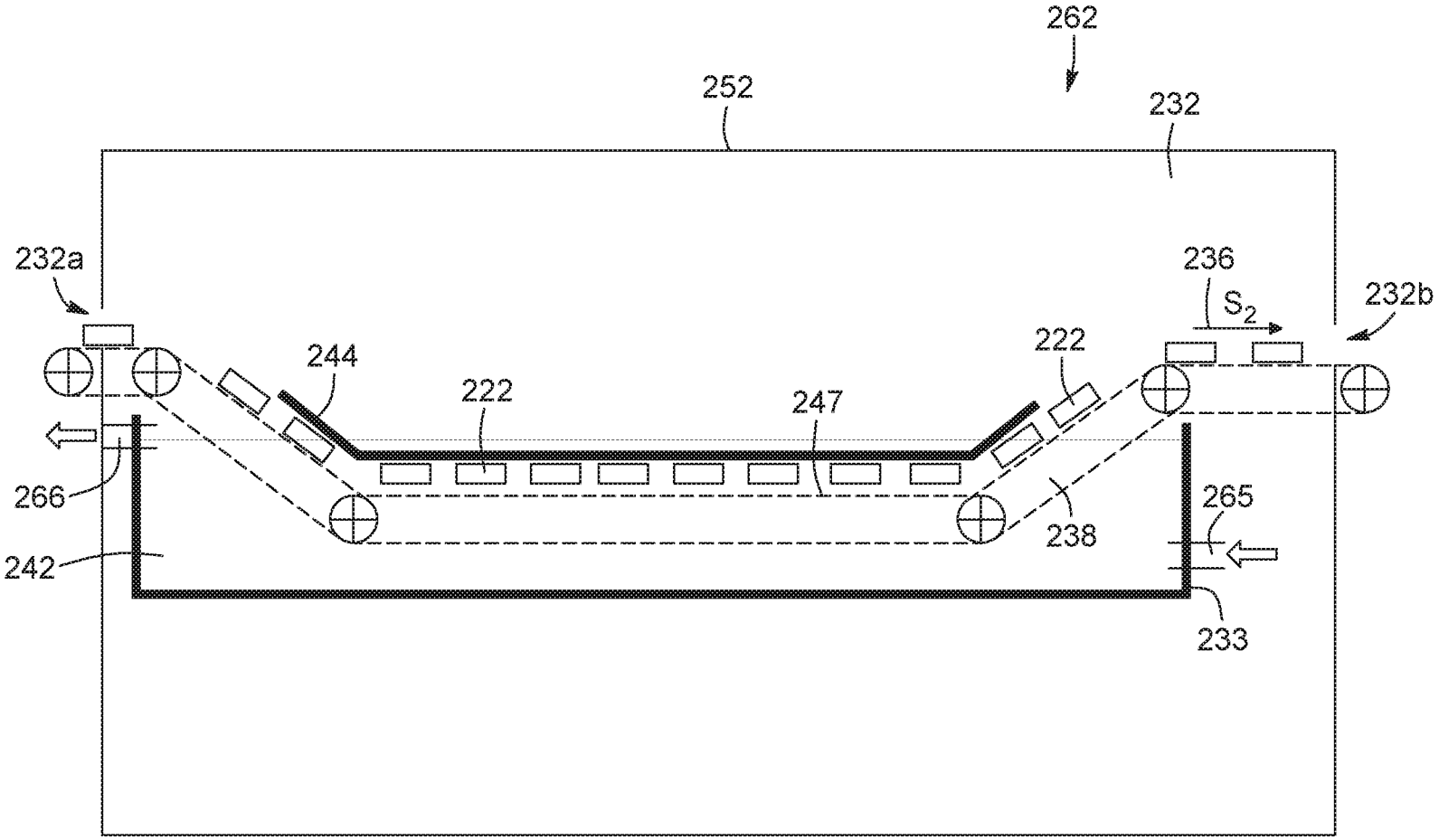
FIG. 6 is a schematic cross-section view of a chemical treatment unit of the apparatus of FIG. 3 for carrying out the chemical treatment step of the lignocellulosic treatment process, in accordance with an alternative embodiment wherein the lignocellulosic pieces are immersed in a preservative solution vat.

In reference to FIG. 6, there is shown an alternative embodiment of the chemical treatment unit 162, wherein similar features are numbered with similar reference numerals in the 200 series. In the embodiment shown in FIG. 6, instead of being sprayed with the preservative solution 242, the lignocellulosic pieces 222 are immersed/submersed in a chemical treatment vat 233 containing the water-based preservative solution 242. More particularly, instead of including preservative solution distribution assembly(ies) such as the above described preservative solution headers 171, the solution distribution assembly of the chemical treatment chamber 232 of FIG. 6 comprises the chemical treatment vat 233 at least partially filled with the water-based preservative solution 242.

In the embodiment shown, the continuous lignocellulosic piece carrier 238 extends through the chemical treatment chamber 232 with the lignocellulosic pieces 222 again being disposed on the carrying surface 247 of the carrier 238. The lignocellulosic pieces 222 are conveyed continuously in the chemical treatment chamber in the direction of arrow 236.

A section of the carrier 238 extends into the chemical treatment vat 233. More specifically, the carrier 238 ingresses into the chemical treatment chamber 232 through the piece entry port 232*a*, before plunging into the chemical treatment vat 233, and travels under the level of the preservative solution 242 into the chemical treatment vat 233, for a certain distance, before emerging therefrom. In the embodiment shown, a submersed guide 244, located above and spaced apart from carrying surface 247 of the carrier 238, is provided to prevent the lignocellulosic pieces 222 from floating away from the carrying surface 247 of the carrier 238 when submersed in the preservative solution 242. Finally, the carrier 238 egresses from the chemical treatment chamber 232 through the piece exit port 232*b*. Thus, the lignocellulosic pieces 222 conveyed by the carrier 238 are in contact with the preservative solution by being submersed in the chemical treatment vat 233, along the section of the carrier 238 which extends under the level of the preservative solution 242 in the chemical treatment vat 233.

Similarly to the embodiment described in connection with FIGS. 2*a* to 2*i*, in the embodiment of FIG. 6, fresh preservative solution 242 (including recycled preservative solution 242) can be supplied, continuously or discontinuously, in the chemical treatment vat 233 operating as solution distribution assembly. In an embodiment, the fresh preservative solution 242 is provided from the preservative solution supply in fluid communication therewith, such as the preservative solution preparation tank which will be described in more details below with regards to FIG. 10, through a preservative solution inlet 265. Preservative solution 242 can also be withdrawn from the chemical treatment vat 233, through a preservative solution outlet 266, to be recycled and/or prevent the preservative solution 242 to overflow.

Figure 7:
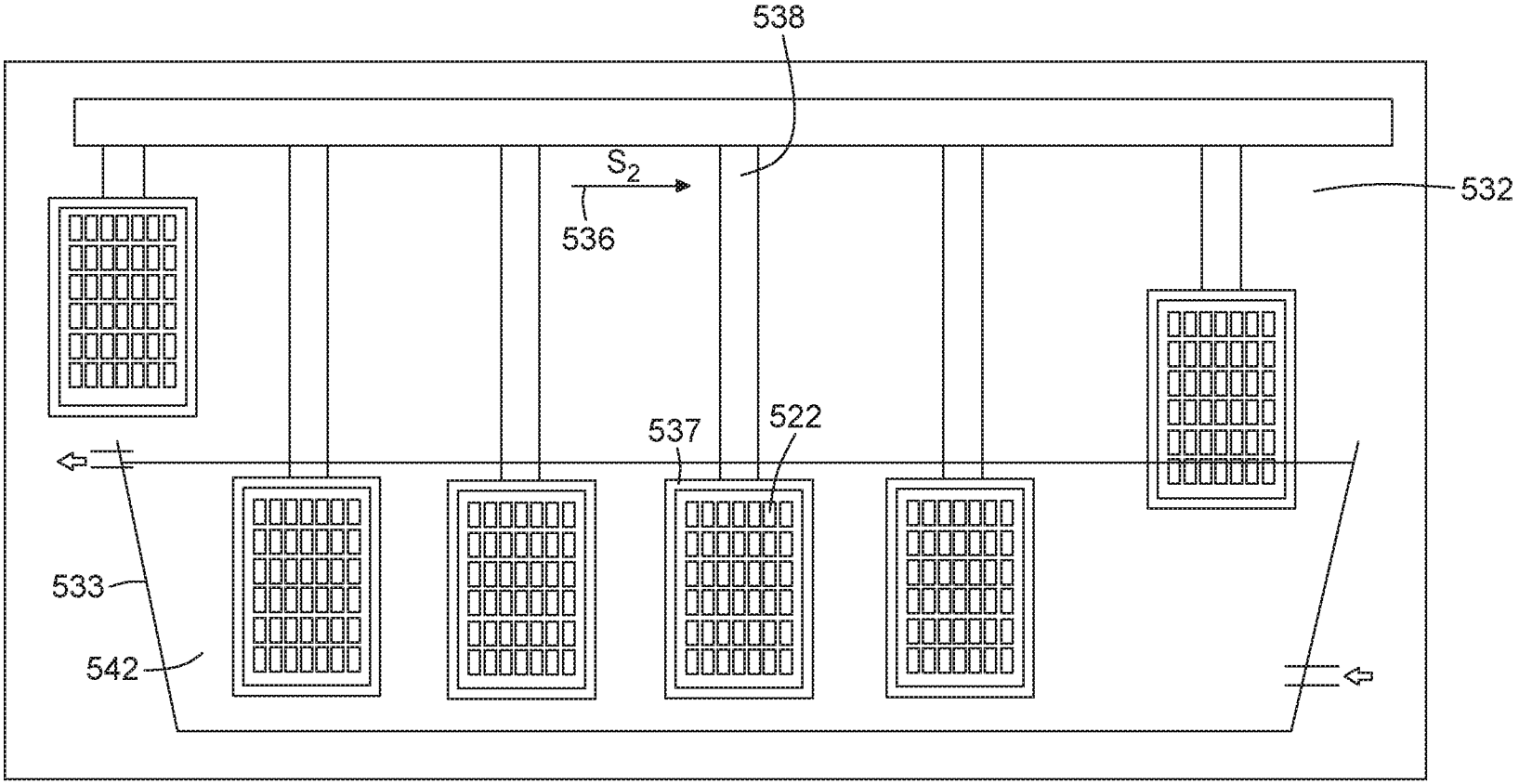
FIG. 7 is a schematic cross-section view of a chemical treatment unit of the apparatus of FIG. 3 for carrying out the chemical treatment step of the lignocellulosic treatment process, in accordance with an alternative embodiment wherein the lignocellulosic pieces are supported in a bundle and immersed in a preservative solution vat.

In reference to FIG. 7, there is shown another alternative embodiment of the chemical treatment unit 162, wherein similar features are numbered with similar reference numerals in the 500 series. Similarly to the embodiment of FIG. 6, the chemical treatment chamber 532 comprises the chemical treatment vat 533 at least partially filled with the water-based preservative solution 542.

In the embodiment of FIG. 7, the lignocellulosic pieces 522 are carried in a bundle, rather than unitarily, as shown in FIG. 6, the corresponding bundles being shown herein in different displacement stages in the chemical treatment chamber 532. In order to allow the displacement of each bundle of lignocellulosic pieces 522, in the embodiment shown, the lignocellulosic pieces 522 are supported and maintained by a lignocellulosic piece support 537 similar to the one described above in connection with FIGS. 2*a* to 2*i*. The lignocellulosic piece support 537 is again engageable with a carrier 538 which allow substantially horizontal and substantially vertical displacement of the lignocellulosic pieces support 537 and the lignocellulosic pieces 522 supported therein. In the embodiment shown, the lignocellulosic piece carrier 538 is similar to the carrier described in connection with FIGS. 2*a* to 2*i*, but one skilled in the art will understand that, in an alternative embodiment, a lignocellulosic piece support 537 and/or lignocellulosic piece carrier 538 different from the embodiment shown, while still allowing the displacement of a bundle of lignocellulosic pieces 522, can be provided.

The bundle of lignocellulosic pieces 522 is conveyed continuously in the chemical treatment chamber 532 in the direction of arrow 536, with the carrier 538 being selectively configured in the submersed configuration and the non-submersed configuration. The lignocellulosic piece carrier 538 is initially configured in the non-submersed configuration. As the lignocellulosic piece support 537 travels over the chemical treatment vat 533, the lignocellulosic piece carrier 538 is configured in the submersed configuration such that the lignocellulosic piece support 537 is lowered into the chemical treatment vat 533 and the lignocellulosic pieces 522 are at least partially submersed in the water-based preservative solution 542 contained therein, while the bundle of lignocellulosic pieces 522 is still conveyed in the direction of arrow 536. Subsequently, the carrier 538 is again configured in the non-submersed configuration to remove the lignocellulosic pieces 522 from the chemical treatment vat 533, for example, as the lignocellulosic piece support 537 reaches an end of the chemical treatment vat 533.

One skilled in the art will understand that the chemical treatment chamber 532 also includes a piece entry port (not shown), and a piece exit port (not shown) to allow the lignocellulosic piece support 537 to ingress therein and egress therefrom. Similarly to the embodiment described in connection with FIGS. 2*a* to 2*i* and 6, fresh preservative solution 542 can be supplied, continuously or discontinuously, in the chemical treatment vat 533, for example from the preservative solution supply in fluid communication therewith and preservative solution 242 can also be withdrawn from the chemical treatment vat 533, to be recycled and/or prevent the preservative solution 542 to overflow.

Once again, one skilled in the art will understand that, in the embodiment shown, the lignocellulosic piece support 537 maintains the lignocellulosic pieces 522 in a substantially horizontal configuration, but that in an alternative embodiment, the lignocellulosic piece support 537 can maintain the lignocellulosic pieces 522 in a different orientation, such as substantially vertically or the like. Moreover, spacers can be provided to maintain the lignocellulosic pieces 522 separated or the lignocellulosic piece support 537 can allow movement of the lignocellulosic pieces 522 therein to temporarily define spaces therebetween and thereby allow the preservative solution 542 to flow therebetween, for example if the lignocellulosic piece support 537 is agitated.

One skilled in the art will understand that even though FIG. 7 shows a plurality of bundle of lignocellulosic pieces 522 being carried simultaneously, in an alternative embodiment a single bundle can be carried inside the chemical treatment chamber 532 at the time. One skilled in the art will understand that, in an embodiment, the above described configuration where the lignocellulosic pieces 522 are carried continuously in a bundle, rather than unitarily, can also be used in the pre-conditioning unit 148 and/or the post-conditioning unit 190, with the necessary adjustments.

In an embodiment, the speed ($s_2$) of the lignocellulosic piece carrier 538 is adjustable and can be adjusted to control the residence time of the lignocellulosic pieces 522 in the chemical treatment chamber 532 and/or the time period where the lignocellulosic piece carrier 538 is configured in each one of the submersed configuration and non-submersed configuration.

Figure 8:
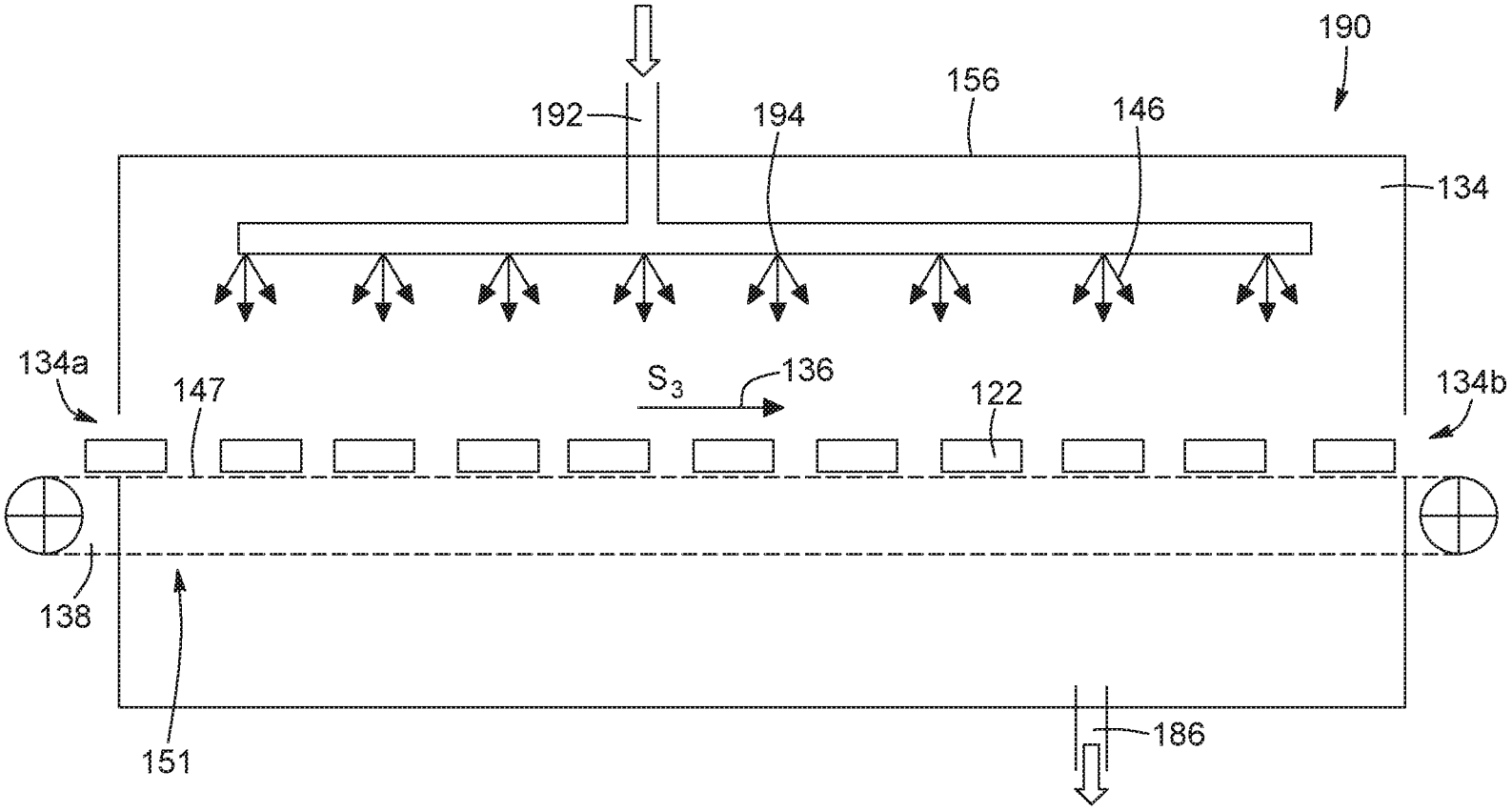
FIG. 8 is a schematic cross-section view of a post-conditioning unit of the apparatus of FIG. 3 for carrying out a post-conditioning step of the lignocellulosic treatment process, in accordance with an embodiment.

Now referring to FIG. 8, there is shown an embodiment of the post-conditioning unit 190, which includes a housing 156 defining the post-conditioning chamber 134 in which the post-conditioning step 128 is performed. The housing 156 comprises a post-conditioning piece entry port 134*a* and a post-conditioning piece exit port 134*b* through which the lignocellulosic pieces 122 continuously ingress to the post-conditioning chamber 134, where the post-conditioning step 128 is performed, and egress from the post-conditioning chamber 134. The housing 156 further comprises a post-conditioning agent outlet 186, which will be described in more details below.

In an alternative embodiment (not shown), the post-conditioning unit 90 can be free of post-conditioning chamber 34. More particularly, the post-conditioning step 28 can be performed without any enclosed space.

Similarly to the above described pre-conditioning unit 148 and chemical treatment unit 162, the continuous lignocellulosic piece carrier 138 extends through the post-conditioning chamber 134, including the post-conditioning piece entry port 134*a* and the post-conditioning piece exit port 134*b*. Once again, the lignocellulosic piece carrier 138 can be the same carrier as the one extending through the pre-conditioning unit 148 and the chemical treatment unit 162 or can be another carrier mounted serially with the carrier 138 extending through the pre-conditioning unit 148 and the chemical treatment unit 162. The lignocellulosic pieces 122 are disposed on the carrying surface 147 of the carrier 138, and conveyed continuously in the post-conditioning chamber 134 in the direction of arrow 136. In an embodiment, the speed ($s_3$) of the continuous lignocellulosic piece carrier 138 is adjustable and can be adjusted to control the residence time of the lignocellulosic pieces 122 in the post-conditioning chamber 134. If the carriers extending in the pre-conditioning unit 148, the chemical treatment unit 162, and the post-conditioning unit 190 are different carriers, the speed ($s_3$) of the carrier extending in the post-conditioning unit 190 can be different from the speed ($s_2$) of the carrier extending in the chemical treatment unit 162 and/or the speed ($s_1$) of the carrier extending in the pre-conditioning unit 148.

As mentioned above, in an embodiment, during the post-conditioning step 128, the lignocellulosic pieces 122 are humidified and heated with the water-based post-conditioning agent 146. In the embodiment shown, the post-conditioning unit 190 comprises a post-conditioning agent supply 192 in fluid communication with the post-conditioning chamber 134. In an embodiment, the post-conditioning agent supply 192 comprises a post-conditioning agent heating unit (not shown) to heat the water-based post-conditioning agent 146, to a temperature above the ambient temperature.

In the embodiment shown, the post-conditioning agent supply 192 comprises a plurality of post-conditioning spray nozzles 194, located in the post-conditioning chamber 134 above and under the carrier 138. The post-conditioning spray nozzles 194 are oriented towards the carrying surface 147 of the carrier 138. It is appreciated that the shape and the configuration of the distribution assembly for the post-conditioning preservative solution can differ from the post-conditioning spray nozzles 194 schematically shown in FIG. 8. Similarly to the above described embodiments, in an alternative embodiment (not shown), the post-conditioning agent 146 can be applied to only one of the upper and lower surfaces of the lignocellulosic pieces 122.

In an alternative embodiment, it is appreciated that the post-conditioning chamber 134 can comprise, in addition to or instead of the post-conditioning spray nozzles 194, different distribution members, such as, for example and without being limitative, a set of hoses, one or more perforated pipes, or the like. In another alternative embodiment (not shown), similarly to the above described pre-conditioning unit 148, the post-conditioning agent supply 192 can include a reservoir filled with heated water (for example, with a temperature between about 70° C. and about 100° C.) and positioned below the carrier 138 or any other known heat and/or humidity control device, in fluid communication with the post-conditioning chamber 134.

In an embodiment, a portion of the supplied water-based post-conditioning agent 146 is absorbed by the lignocellulosic pieces 122, in the post-conditioning chamber 134, while a remaining and condensed portion reaches gravitationally the post-conditioning agent outlet 186. In an embodiment, the remaining and condensed portion of the post-conditioning agent 146 is recovered and can be recycled (or reused) in the process. More particularly, the recovered portion of the water-based post-conditioning agent 146 can be returned, directly or indirectly to the post-conditioning agent supply 192 to be reinjected into the post-conditioning chamber 134.

Figure 9:
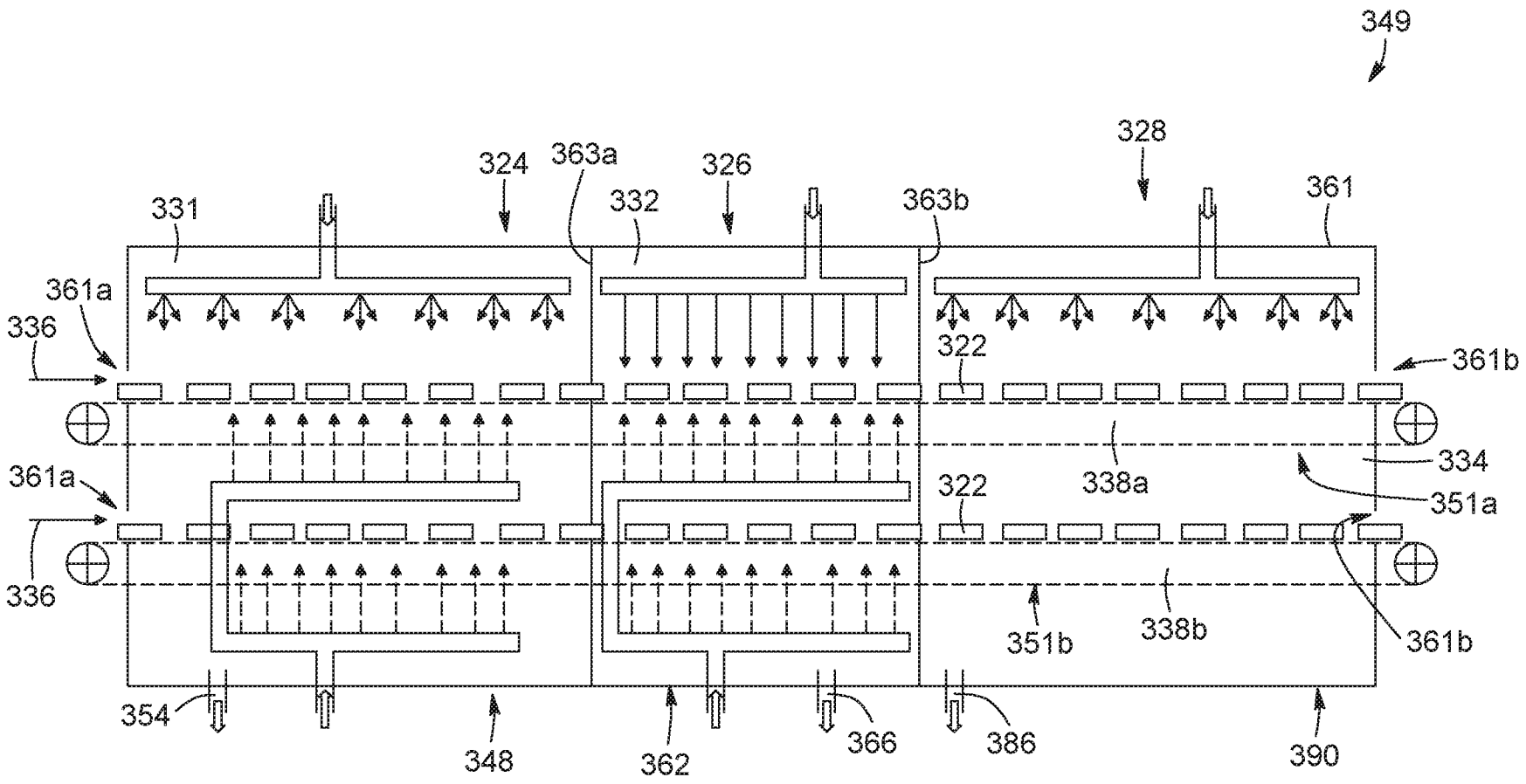
FIG. 9 is a schematic cross-section view of an apparatus for carrying out the lignocellulosic treatment process, in accordance with another embodiment wherein each one of the pre-conditioning unit, the chemical treatment unit, and the post-conditioning unit includes a plurality of production lines.

In reference to FIG. 9, there is shown an alternative embodiment of the apparatus 149, wherein similar features are numbered with similar reference numerals in the 300 series. In the embodiment shown, the lignocellulosic treatment apparatus 349 includes a plurality of production lines 351*a*, 351*b*, extending substantially parallel to one another, in each one of the pre-conditioning unit 348, the chemical treatment unit 362 and the post-conditioning unit 390. Furthermore, the apparatus 349 comprises a single housing 361 with a piece entry port 361*a* and a piece exit port 361*b*. In the embodiment shown, the housing 361 also includes partition walls 363*a*, 363*b* extending therein to define the pre-conditioning chamber 331, the chemical treatment chamber 332, and the post-conditioning chamber 334 in which the pre-conditioning step 324, chemical treatment step 326, post-conditioning step 328 are respectively performed. In an embodiment, the housing 361 can be free of partition walls 363*a*, 363*b*, thus defining a single chamber without partition walls extending therein to separate the housing into the pre-conditioning chamber 331, the chemical treatment chamber 332 and the post-conditioning chamber 334.

In the embodiment shown, the lignocellulosic pieces 322 are conveyed through the apparatus 349, in direction of arrow 336, by two continuous lignocellulosic piece carriers 338*a*, 338*b* extending continuously in and between the pre-conditioning chamber 331, the chemical treatment chamber 332 and the post-conditioning chamber 334. Each one of the carriers 338*a*, 338*b* defines one of the production lines 351*a*, 351*b*. It is appreciated that the number of carriers and, consequently, production lines 351*a*, 351*b* can differ from the embodiment shown.

Both carriers 338*a*, 338*b* extend through the piece entry port 361*a* and the piece exit port 361*b* of the housing 361. Other features of the apparatus 349, including and without being limitative, the outlets 354, 366 and 386, are similar to the apparatus 149 described in connection to FIGS. 3 to 5 and 8 and will not be described in further details herein.

One skilled in the art will understand that combinations of the apparatuses 149, 349 described in FIGS. 3 to 9 can be foreseen. For instance, at least one of the pre-conditioning unit 148, the chemical treatment unit 162 and the post-conditioning unit 190 as described in connection to FIGS. 3 to 7 can include a plurality of production lines 151, at least one of the pre-conditioning unit 348, the chemical treatment unit 362 and the post-conditioning unit 390 described in connection to FIG. 9 can include a single production line 151, or the like.

Figure 10:
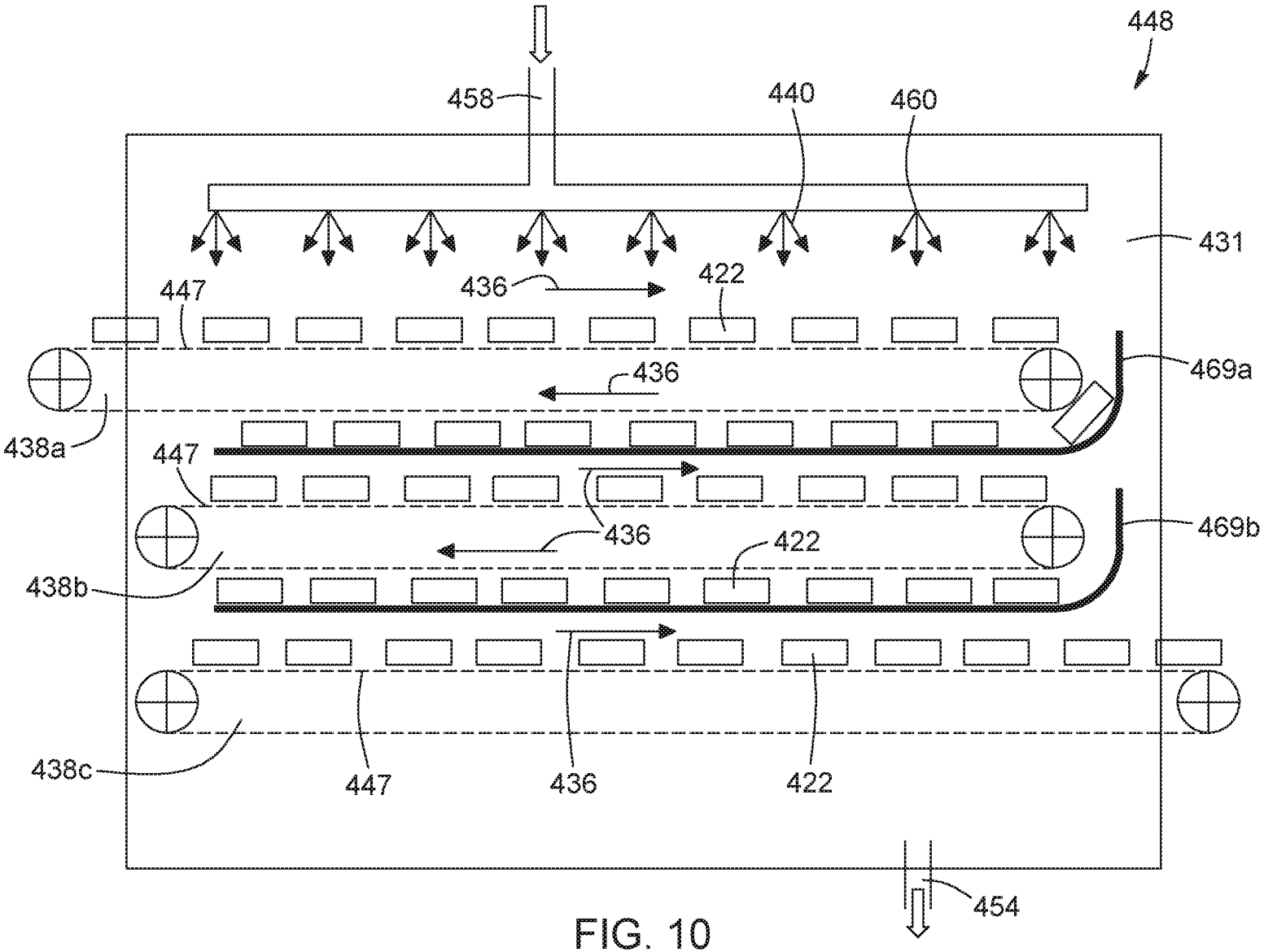
FIG. 10 is a schematic cross-section view of the pre-conditioning unit of the apparatus of FIG. 3 for carrying out the lignocellulosic treatment process, in accordance with an embodiment with an elongated lignocellulosic piece path.

Referring to FIG. 10, there is shown an alternative embodiment, of the pre-conditioning unit 148, wherein similar features are numbered with similar reference numerals in the 400 series. One skilled in the art will understand that even though FIG. 10 presents an alternative embodiment of the pre-conditioning unit 148, in alternative embodiments, a similar configuration as the one shown in FIG. 10 can also be provided for the chemical treatment unit 162 and/or the post-conditioning unit 190 with the necessary adjustments.

In the embodiment shown, the lignocellulosic pieces 422 are conveyed along an elongated lignocellulosic piece path. More particularly, the lignocellulosic pieces 422 are conveyed in the pre-conditioning chamber 431 such that they complete several passes therein.

In the embodiment shown, the pre-conditioning chamber 431 comprises a plurality of the lignocellulosic piece carriers 438 disposed in a series configuration. In the embodiment shown, three carriers 438*a*, 438*b*, 438*c* are disposed in the series configuration, one above the other. Elongated piece guiding members 469*a*, 469*b* are mounted in the pre-conditioning chamber 431, below each one of the first and second carriers 438*a*, 438*b*, in a spaced-apart relationship with a lower surface thereof. In an embodiment, spaced-apart cleats or anchors can be mounted to the carrying surface 447 of the carriers 438*a*, 438*b* and 438*c* to engage the conveyed lignocellulosic pieces 422. The lignocellulosic pieces 422 are first conveyed in the direction of arrow 436 on the upper surface of the first carrier 438*a*. At the end of the first carrier 438*a*, the lignocellulosic pieces 422 are brought down of the carrier 438*a*, by gravity, towards the first elongated piece guiding members 469*a*, wherein they are maintained in contact with a lower surface of the first carrier 438*a*. On the first elongated piece guiding members 469*a*, the lignocellulosic pieces 22 are conveyed in an opposite direction to arrow 436 by engagement with the lower surface of the first carrier 438*a*, towards an end of the first elongated piece guiding members 469*a*. At the end of the first elongated piece guiding members 469*a*, the lignocellulosic pieces 422 are again brought down, by gravity, towards an upper surface of the second carrier 438*b*, wherein they are again carried towards an end thereof. The lignocellulosic pieces 422 are then conveyed sequentially along a similar path by the second carrier 438*b* and second elongated piece guiding member 469*b*, towards the third carrier 438*c*. The third carrier 438*c* conveys the lignocellulosic pieces 422 outwardly of the pre-conditioning chamber 431 through the pre-conditioning piece exit port 431*b*

Similarly to the embodiment of FIG. 4, in the embodiment shown, the pre-conditioning unit 448 also comprises a pre-conditioning agent supply 458 located in the pre-conditioning chamber 431, above the carriers 438, and having a plurality of pre-conditioning spray nozzles 460 to dispense water-based pre-conditioning agent 440 towards the carrying surface 447 of the carriers 438. Once again, in an alternative embodiment, it is appreciated that the pre-conditioning chamber 431 can include distribution assemblies different from the embodiment shown, such as a plurality of sprinklers, a set of hoses, one or more perforated pipes, or any other assembly which allow the heating and humidifying of the lignocellulosic pieces 422 conveyed in the pre-conditioning unit 448.

It is appreciated that, in alternative embodiments (not shown), the pre-conditioning unit 448 can include more or less than the three carriers 438*a*, 438*b*, 438*c* and two elongated piece guiding members 469*a*, 469*b* shown. Furthermore, in an alternative embodiment, the pre-conditioning unit 448 can be free of elongated piece guiding members 469*a*, 469*b*, the lignocellulosic pieces 422 being, for example, conveyed in the direction opposite to arrow 436, by additional carriers running in a direction opposite to the carriers 438*a*, 438*b*, 438*c*.

One skilled in the art will understand that additional features of the pre-conditioning units 148 of FIG. 4, can also be included in the pre-conditioning unit 448 and need not be repeated and described in further details herein.

Figure 11:
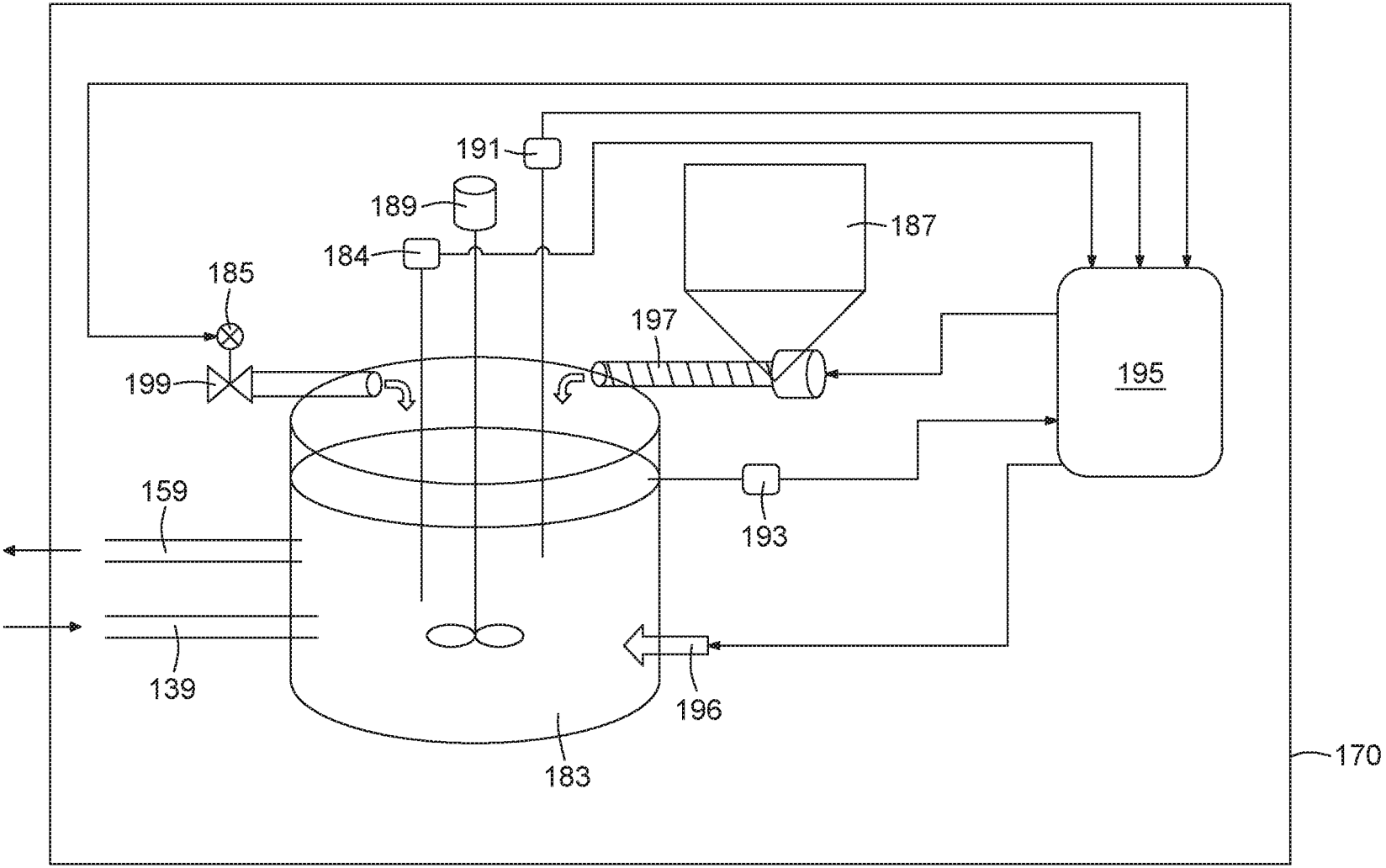
FIG. 11 is a schematic view of a preservative solution supply in accordance with an embodiment.

Now referring to FIG. 11, there is shown an embodiment of a preservative solution supply 170 including a preservative solution preparation tank 183, a water supply 185, a preservative bin 187, a stirrer 189, a concentration probe 191 (or densimeter), a heating assembly 196, a liquid level probe 193, a control system 195, a preservative solution supply inlet 139 and a preservative solution supply outlet 159. One skilled in the art will understand that, in an embodiment where a chemical treatment vat is provided, the vat can be used as preparation tank and the additional components can cooperate directly with the vat to prepare the preservative solution directly therein.

In the embodiment shown, the concentration probe 191 is operative to measure the preservative concentration of the water based preservative solution 142 inside the preservative solution preparation tank 183 and the data acquired by the concentration probe 191 is transmitted to the control system 195. The control system 195 is operatively connected to a closing screw 197 connected to an outlet of the preservative bin 187, and a water control valve 199 connected to an outlet of the water supply 185. Based on the data transmitted by the concentration probe 191 to the control system 195, the control system 195 actuates the closing screw 197 to supply the preservative solution preparation tank 183 with the lignocellulosic preservative contained in the preservative bin 187 and/or open/close the water control valve 199 to allow water to flow from the water supply 185 into the preservative solution preparation tank 183.

One skilled in the art will understand that, in an alternative embodiment, components and/or method different than the above described concentration probe 191 can be used to measure the preservative concentration of the water based preservative solution 142 inside the preservative solution preparation tank 183. For example and without being limitative, in an embodiment (not shown), load cells can be used to measure the weight of the preservative solution preparation tank 183 and thereby determine the required quantity of lignocellulosic preservative for the specific volume of the water based preservative solution 142.

The stirrer 189 can be actuated continuously or intermittently to homogenize the water-based preservative solution 142 contained in the preservative solution preparation tank 183. Several types of stirrers 189 can be foreseen, such as, for example and without being limitative, a mechanical stirrer, a meandering channel wherein water and the preservative are injected at high velocity, a magnetic stirrer, and the like. Additionally, a penetrant accelerant (not shown) can also be added to the water-based preservative solution 142, wherein the penetrant accelerant facilitates the impregnation of the preservative into the lignocellulosic pieces 22.

The temperature of the water-based preservative solution 142 contained in the preservative solution preparation tank 183 is measured by a temperature probe 184 and the data is also transmitted to the control system 195. The control system 195 is operatively connected to the heating assembly 196. Based on the data transmitted by the temperature probe 184 to the control system 195, the control system 195 controls the heating assembly 196 to heat the preservative solution 142 contained in the preservative solution preparation tank 183. The heating assembly 196 can have a section extending in the preservative solution preparation tank 183 or close to the preservative solution preparation tank 183 to heat, directly or indirectly, the preservative solution 142 contained therein.

As mentioned above, in an embodiment, in order to further increase the dissolution of the lignocellulosic material preservative in water, the heating assembly 196 heats the water based preservative solution 142 to a temperature higher than the contact temperature of the water based preservative solution 142 during the preparation of the solution, i.e. a temperature above the temperature of the solution 142 when in contact with the lignocellulosic pieces 22.

In the embodiment shown, the level of the water-based preservative solution 142 in the preservative solution preparation tank 183 is monitored by the liquid level probe 193.

The water-based preservative solution 142 is conveyed to one of the chemical treatment unit 162 or the chemical treatment vat 33, 233 through the preservative solution supply outlet 159. In embodiments where water-based preservative solution is recycled, the recycled portion of the water-based preservative solution 142, for example collected by the preservative solution outlet 166 defined in the chemical treatment unit 162 (See FIG. 5), is brought in the preservative solution preparation tank 83 through the preservative solution supply inlet 139.

The control system 195 is operative to control the actuators, such as the closing screw 197, the stirrer 189, and the water control valve 199, based on the data received from the monitoring devices, such as the concentration probe 191 and the temperature probe 184. The control system 195 can be any known system with such capabilities, such as, for example and without being limitative, a digital control system or the like.

It is appreciated that, in an embodiment, the preservative solution supply 170 can also comprise a buffer tank mounted between the preservative solution preparation tank 183 and the distribution assembly to contain the preservation solution 142 before being transferred to one of the process chamber 30 and the chemical treatment chamber 132.

Test Results

Tests were performed on wood pieces cut from ordinary 2 inches×4 inches lumbers, which have been previously dried and planned. The pieces were 9 cm to 22 cm long. A suitable coating was applied on the cross section surfaces to prevent end effects. The moisture content of the wood pieces was adjusted.

The following lignocellulosic treatment process was applied. During the pre-conditioning step, the wood pieces were heated with either hot water or water vapor. Then, during the chemical treatment step, the preservative solution was applied by immersion of the wood pieces in a vat containing the preservative solution or by spraying the preservative solution on the wood pieces. The preservative solution contained disodium octaborate tetrahydrate (DOT) as wood preservative. Then, during the post-conditioning step, the wood pieces were maintained in a warm and humid atmosphere for a maximum of about 10 minutes, then cooled down and kept at room temperature. After each tests, the wood pieces were temporarily kept in a closed plastic box and subsequently stacked in a bundle, strapped, and wrapped in a conventional packaging membrane over five faces (the bottom not being wrapped).

The lignocellulosic treatment process is detailed in table 1 below.

TABLE 1

Lignocellulosic treatment process parameters of initial testing.

| Parameters used for test | Values |
|---|---|
| Species | Spruce, Balsam Fir, Southern Yellow Pine (SYP) |
| Moisture content of wood before treatment | 20 wt % to 50 wt %, generally between 20 wt % to 25 wt % |
| Pre-conditioning with hot water or water vapor | Temperature: between 75° C. and 100° C.<br>Pre-conditioning time period: 0 to 5 minutes |
| DOT concentration in preservative solution | 25% wt to 46% wt |
| Temperature of preservative solution | Between 75° C. and 95° C. |
| Contact time between the wood pieces and the preservative solution | 1 to 5 min |
| Post-conditioning step | Temperature: about 80° C.<br>Post-conditioning time period: 0 to 10 minutes |

TABLE 2

Parameters of additional test of the effect of the quantity of chemical treatment steps.

| Parameters used for test | Values |
|---|---|
| Species | Black spruce, Balsam Fir |
| Moisture content of wood before treatment | 10 wt % to 25 wt %, generally between 15 wt % to 20 wt % |
| Pre-conditioning with water vapor | Temperature: between 75° C. and 100° C.<br>Pre-conditioning time period: 4 minutes |
| DOT concentration in preservative solution | 47% wt |
| Temperature of preservative solution | Between 85° C. and 95° C. |

TABLE 2-continued

Parameters of additional test of the effect of the quantity of chemical treatment steps.

| Parameters used for test | Values |
|---|---|
| Submersion time | 1 min |
| Post-conditioning step in heated environment | Temperature: about 80° C.<br>Relative humidity: between 70% and 100%<br>Post-conditioning time period: 10 minutes |
| Quantity of chemical treatment step | 2, 3, and 4* |

*Each chemical treatment phase is followed by a post-conditioning step

TABLE 3

Example -Parameters of additional test of the effect chemical treatment time period.

| Parameters used for test | Values |
|---|---|
| Species | Black spruce, Balsam Fir |
| Moisture content of wood before treatment | 10 wt % to 25 wt %, generally between 15 wt % to 20 wt % |
| Pre-conditioning | None |
| DOT concentration in preservative solution | 47% wt |
| Temperature of preservative solution | Between 85° C. and 95° C. |
| Submersion time | Between 10, 20 and 30 minutes |
| Post-conditioning step in heated environment | Temperature: about 80° C.<br>Relative humidity: between 70% and 100%<br>Post-conditioning time period: 10 minutes |

TABLE 4

Example -Parameters of additional test of the effect post-conditioning step.

| Parameters used for test | Values |
|---|---|
| Species | Black spruce, Balsam Fir |
| Moisture content of wood before treatment | 10 wt % to 25 wt %, generally between 15 wt % to 20 wt % |
| Pre-conditioning | None |
| DOT concentration in preservative solution | 47% wt |
| Temperature of preservative solution | Between 85° C. and 95° C. |
| Submersion time | 10 minutes |
| Post-conditioning step in heated environment | Temperature: about 80° C.<br>Relative humidity: between 70% and 100%<br>Post-conditioning time period: 10 minutes<br>Once with post-conditioning, once without post-conditioning |

TABLE 5

Example -Parameters of additional test of the effect of wood species.

| Parameters used for test | Values |
|---|---|
| Species | Black spruce, Balsam Fir, Southern Yellow Pine (SYP) |
| Moisture content of wood before treatment | 10 wt % to 25 wt %, generally between 15 wt % to 20 wt % |
| Pre-conditioning | None |
| DOT concentration in preservative solution | 47% wt |

TABLE 5-continued

| Example -Parameters of additional test of the effect of wood species. | |
|---|---|
| Parameters used for test | Values |
| Temperature of preservative solution | Between 85° C. and 95° C. |
| Submersion time | 10, 20 minutes |
| Post-conditioning step in heated environment | Temperature: about 80° C.<br>Relative humidity: between 70% and 100%<br>Post-conditioning time period: 10 minutes |

At least two weeks following the above-described lignocellulosic treatment processes, slices of the wood pieces were cut in the middle of the samples. Assays were performed on the slices. More particularly, the wood pieces were initially dried at 45° C. for 18 hours to assess moisture content. Then, the samples of wood were cut 0.0" to 0.6" from the edge of the board as this area constitutes the assay zone as outlined in the standard AWPA T1-12, Table 11, sawn products of the American Wood Protection Association (AWPA). The samples were then ground and refluxed in hydrogen chloride (HCl) for two hours. The recovered leachate was then cooled and filtered before being analyzed for boron content against matrix matched standards using inductively coupled plasma atomic emission spectroscopy (ICP-OES). Results are shown in Tables 1.1 to 1.5.2 below.

TABLE 1.1

Results of the initial testing.

| | Best retention obtained | |
|---|---|---|
| Species | DOT (% wt) | BAE* (% wt) |
| Spruce | 2.05 | 2.45 |
| Balsam Fir | 3.07 | 3.68 |
| Southern Yellow Pine | 1.73 | 2.07 |

*BAE: Boric Acid Equivalent

TABLE 1.2

Results of the effect of the quantity of chemical treatment phases

| Number of chemical | Retention obtained (% DOT wt.) | |
|---|---|---|
| treatment steps | Black Spruce | Balsam Fir |
| 2 | 0.99 | 2.13 |
| 3 | 1.08 | 2.22 |
| 4 | 1.29 | 1.37 |

TABLE 1.3

Results of the effect of the chemical treatment time period

| Chemical treatment time | Retention obtained (% DOT wt.) | |
|---|---|---|
| period (min) | Black Spruce | Balsam Fir |
| 10 | 1.47 | 2.17 |
| 20 | 1.40 | 2.22 |
| 30 | 1.31 | 2.59 |

TABLE 1.4

Results of the effect of the post-conditioning step

| | Retention obtained (% DOT wt.) | |
|---|---|---|
| Post-conditioning step | Black Spruce | Balsam Fir |
| No | 1.21 | 1.73 |
| yes | 1.47 | 2.17 |

TABLE 1.5.1

Results of the effect of the species for chemical treatment period of 10 minutes with post-conditioning. Species effect

| | Black Spruce | Balsam Fir | Southern Yellow Pine (SYP) |
|---|---|---|---|
| Retention obtained (% DOT wt.) | 1.47 | 2.17 | 2.28 |

TABLE 1.5.2

Results of the effect of the species for chemical treatment period of 20 minutes with post-conditioning Species effect

| | Black Spruce | Balsam Fir | Southern Yellow Pine (SYP) |
|---|---|---|---|
| Retention obtained (% DOT wt.) | 1.4 | 2.22 | 3.19 |

The above mentioned results show that, in some implementations, the method and apparatuses described above can be used to reach or exceed national or international standards, such as for example the standards established by the American Wood Protection Association (AWPA) in the United states.

It will be appreciated that the methods described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A process for treating lignocellulosic pieces with a water-soluble lignocellulosic material preservative, the process comprising the step of:

preparing a water-based preservative solution by dissolving the water-soluble lignocellulosic material preservative comprising disodium octaborate tetrahydrate (DOT) in a concentration above 40% wt, in water at a preparation temperature;

lowering a temperature of the water-based preservative solution from the preparation temperature to a contact temperature lower than the preparation temperature; and submersing the lignocellulosic pieces with the water-based preservative solution at the contact temperature, the contact temperature being between 85° C. and 95° C.

2. The process of claim 1, wherein the preservative solution contains the water-soluble lignocellulosic material preservative in a concentration between 45% wt and 50% wt.

3. The process of claim 1, wherein the step of submersing the lignocellulosic pieces with the water-based preservative solution is performed at atmospheric pressure.

4. The process of claim 1, further comprising the step of maintaining the treated lignocellulosic pieces in a post-conditioning environment at atmospheric pressure and having a temperature between 60° C. and 95° C. and a relative humidity between 50% and 100%.

5. The process of claim 4, wherein the step of maintaining the chemically treated lignocellulosic pieces in the post-conditioning environment comprises the substep of exposing the chemically treated lignocellulosic pieces to a water-based post-conditioning agent having a temperature between 60° C. and 95° C.

6. The process of claim 5, wherein the post-conditioning agent comprises water vapor.

7. The process of claim 4, wherein the step of maintaining the chemically treated lignocellulosic pieces in the post-conditioning environment is performed between during 30 seconds and 15 minutes.

8. The process of claim 7, wherein the step of maintaining the chemically treated lignocellulosic pieces in the post-conditioning environment is performed during 5 minutes and 12 minutes.

9. The process of claim 4, wherein a sequence of submersing the lignocellulosic pieces with the water-based preservative solution and maintaining the chemically treated lignocellulosic pieces in the post-conditioning environment is performed a plurality of times.

10. The process of claim 1, further comprising an initial step of maintaining the lignocellulosic pieces in a pre-conditioning environment having a temperature above the ambient temperature and a humidity level above the ambient humidity to heat and humidify the lignocellulosic pieces and the step of maintaining the lignocellulosic pieces in the pre-conditioning environment comprises the substep of exposing the lignocellulosic pieces to a water-based pre-conditioning agent having a temperature between 70° C. and 100° C. when in contact with the lignocellulosic pieces.

11. The process of claim 10, wherein the step of maintaining the lignocellulosic pieces in a pre-conditioning environment is performed during between 30 seconds and 5 minutes and the water-based pre-conditioning agent comprises at least one of hot water and water vapor.

12. The process of claim 10, wherein the lignocellulosic pieces have a moisture content between 10% wt and 20% wt before being maintained in the pre-conditioning environment.

13. The process of claim 1, wherein the step of submersing the lignocellulosic pieces with the water-based preservative solution is performed during between 30 seconds and 30 minutes.

14. The process of claim 13, wherein the step of submersing the lignocellulosic pieces with the water-based preservative solution is performed during less than 15 minutes.

15. The process of claim 1, wherein the step of preparing the water-based preservative solution at a temperature higher than the contact temperature comprises preparing the water-based preservative solution at a temperature above 95° C. and below 100° C.

16. The process of claim 1, wherein the lignocellulosic pieces initially comprise dried and planed lignocellulosic pieces.

* * * * *